US008746144B2

(12) United States Patent
Givens et al.

(10) Patent No.: US 8,746,144 B2
(45) **Date of Patent: *Jun. 10, 2014**

(54) ELECTRONIC DETONATOR SYSTEM

(71) Applicant: Battelle Memorial Institute, Columbus, OH (US)

(72) Inventors: Richard W. Givens, Humble, TX (US); Ronald L. Loeser, Bexley, OH (US); Roger F. Backhus, Plain City, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/905,798

(22) Filed: May 30, 2013

(65) Prior Publication Data

US 2014/0123866 A1 May 8, 2014

Related U.S. Application Data

(63) Continuation of application No. 13/091,707, filed on Apr. 21, 2011, now Pat. No. 8,468,944, which is a continuation of application No. PCT/US2009/061961, filed on Oct. 23, 2009.

(60) Provisional application No. 61/108,277, filed on Oct. 24, 2008.

(51) Int. Cl.
*F42B 3/10* (2006.01)

(52) U.S. Cl.
USPC ..... 102/311; 102/206; 102/217; 102/275.11; 102/202.8

(58) Field of Classification Search
USPC ..... 102/202.1, 202.5, 202.7, 202.8, 204, 102/206, 207, 217, 175.11, 301, 311, 322
See application file for complete search history.

(56) References Cited

U.S. PATENT DOCUMENTS 3,611,939 A * 10/1971 Stadler et al. ..... 102/204
3,638,035 A * 1/1972 Murphy et al. ..... 307/141

(Continued)

FOREIGN PATENT DOCUMENTS

WO 2006/047823 A1 5/2006
WO 2006/076777 A1 7/2006

(Continued)

OTHER PUBLICATIONS

Notification of Transmittal of the International Search Report and the Written Opinion of the International Searching Authority for PCT Application No. PCT/US2009/061961, mailing date of Jan. 21, 2010; International Search Report and Written Opinion of the International Searching Authority, European Patent Office; Rijswijk, Netherlands.

(Continued)

*Primary Examiner* — Bret Hayes
*Assistant Examiner* — Derrick Morgan
(74) *Attorney, Agent, or Firm* — Thomas E. Lees, LLC

(57) ABSTRACT

A detonator includes a high voltage switch, an initiator and an initiating pellet. The detonator also includes a low voltage to high voltage firing set coupled to the switch and initiator such that the detonator includes a high voltage power source and initiator in an integrated package. The detonator may also include inductive powering and communications, a microprocessor, tracking and/or locating technologies, such as RFID, GPS, etc., and either a single or combination explosive output pellet. The combination explosive pellet has a first explosive having a first shock energy and a high brisance secondary explosive in the output pellet having a second shock energy greater than the shock energy of the first explosive. Systems are also provided for facilitating fast and easy deployment of one or more detonators in the field.

19 Claims, 11 Drawing Sheets

(56) References Cited

U.S. PATENT DOCUMENTS

| | | | | | |
|---|---|---|---|---|---|
| 3,682,098 | A * | 8/1972 | Spies | 102/206 |
| 4,103,619 | A * | 8/1978 | Fletcher et al. | 361/248 |
| 4,425,849 | A * | 1/1984 | Jorgenson | 102/275.12 |
| 4,471,697 | A * | 9/1984 | McCormick et al. | 102/202.14 |
| 4,537,131 | A | 8/1985 | Saunders | |
| 4,559,875 | A * | 12/1985 | Marshall | 102/218 |
| 4,648,319 | A * | 3/1987 | Westerlund et al. | 102/202.12 |
| 4,685,396 | A * | 8/1987 | Birse et al. | 102/506 |
| 4,782,911 | A * | 11/1988 | Dixon et al. | 181/107 |
| 4,840,122 | A * | 6/1989 | Nerheim | 102/202.5 |
| 4,846,066 | A | 7/1989 | Beattie et al. | |
| 4,848,232 | A | 7/1989 | Kurokawa et al. | |
| 4,869,171 | A | 9/1989 | Abouav | |
| 5,063,846 | A | 11/1991 | Willis et al. | |
| 5,069,129 | A | 12/1991 | Kunitomo | |
| 5,080,016 | A | 1/1992 | Osher | |
| 5,090,321 | A * | 2/1992 | Abouav | 102/200 |
| 5,214,236 | A | 5/1993 | Murphy et al. | |
| 5,291,828 | A * | 3/1994 | Nerheim et al. | 102/202 |
| 5,295,438 | A * | 3/1994 | Hill et al. | 102/217 |
| 5,341,742 | A | 8/1994 | Alford et al. | |
| 5,431,104 | A * | 7/1995 | Barker | 102/312 |
| 5,488,908 | A | 2/1996 | Gilpin et al. | |
| 5,517,920 | A | 5/1996 | Hinz et al. | |
| 5,520,114 | A | 5/1996 | Guimard et al. | |
| 5,600,293 | A * | 2/1997 | Hunter | 336/182 |
| 5,641,935 | A | 6/1997 | Hunter et al. | |
| 5,714,712 | A | 2/1998 | Ewick et al. | |
| 5,861,570 | A * | 1/1999 | Bickes et al. | 102/202.7 |
| 5,894,103 | A | 4/1999 | Shann | |
| 5,906,804 | A | 5/1999 | Aral et al. | |
| 5,942,717 | A | 8/1999 | Pathe et al. | |
| 5,945,627 | A | 8/1999 | Arpin et al. | |
| 5,969,286 | A * | 10/1999 | Ward et al. | 102/202.7 |
| 5,979,327 | A | 11/1999 | Thomson | |
| 6,027,588 | A | 2/2000 | Vattipalli et al. | |
| 6,051,086 | A | 4/2000 | Villamagna et al. | |
| 6,056,853 | A | 5/2000 | Vincent et al. | |
| 6,070,511 | A | 6/2000 | Palmer et al. | |
| 6,082,264 | A | 7/2000 | Meyer et al. | |
| 6,085,659 | A | 7/2000 | Beukes et al. | |
| 6,112,666 | A | 9/2000 | Murray et al. | |
| 6,123,025 | A | 9/2000 | Jacob et al. | |
| 6,138,571 | A | 10/2000 | Denney | |
| 6,147,260 | A | 11/2000 | Bird et al. | |
| 6,165,297 | A | 12/2000 | Smith et al. | |
| 6,173,651 | B1 | 1/2001 | Pathe et al. | |
| 6,209,458 | B1 | 4/2001 | Thomson et al. | |
| 6,283,227 | B1 | 9/2001 | Lerche et al. | |
| 6,327,978 | B1 * | 12/2001 | Turano et al. | 102/202.7 |
| 6,335,314 | B1 | 1/2002 | Salter et al. | |
| 6,385,031 | B1 * | 5/2002 | Lerche et al. | 361/248 |
| 6,386,108 | B1 * | 5/2002 | Brooks et al. | 102/217 |
| 6,389,975 | B1 | 5/2002 | Haddon et al. | |
| 6,420,474 | B1 | 7/2002 | Carey et al. | |
| 6,422,145 | B1 * | 7/2002 | Gavrilovic et al. | 102/200 |
| 6,422,147 | B1 | 7/2002 | Shann | |
| 6,453,818 | B1 | 9/2002 | Brent | |
| 6,513,437 | B2 | 2/2003 | Chan et al. | |
| 6,524,437 | B1 | 2/2003 | Vincent et al. | |
| 6,533,967 | B1 | 3/2003 | Ritchie et al. | |
| 6,590,030 | B2 | 7/2003 | Salter et al. | |
| 6,604,584 | B2 | 8/2003 | Lerche et al. | |
| 6,618,237 | B2 * | 9/2003 | Eddy et al. | 361/249 |
| 6,634,298 | B1 | 10/2003 | Denney | |
| 6,644,202 | B1 | 11/2003 | Duniam et al. | |
| 6,655,289 | B1 | 12/2003 | Bornheim et al. | |
| 6,659,010 | B2 | 12/2003 | Goernig et al. | |
| 6,669,849 | B1 | 12/2003 | Nguyen et al. | |
| 6,718,881 | B2 | 4/2004 | Rauscher, Jr. | |
| 6,732,656 | B1 | 5/2004 | Heyse et al. | |
| 6,752,083 | B1 * | 6/2004 | Lerche et al. | 102/202.7 |
| 6,777,454 | B2 | 8/2004 | Ritchie et al. | |
| 6,777,489 | B1 | 8/2004 | Carey et al. | |
| 6,781,813 | B1 | 8/2004 | Bornheim et al. | |
| 6,785,116 | B1 | 8/2004 | Hummel et al. | |
| 6,837,163 | B2 | 1/2005 | Hallin et al. | |
| 6,851,370 | B2 * | 2/2005 | Reynolds et al. | 102/202.8 |
| 6,941,870 | B2 | 9/2005 | McClure et al. | |
| 6,945,174 | B2 | 9/2005 | Aebi et al. | |
| 6,966,262 | B2 | 11/2005 | Jennings, III | |
| 6,977,468 | B1 * | 12/2005 | Baginski | 313/602 |
| 6,988,449 | B2 | 1/2006 | Teowee et al. | |
| 7,017,494 | B2 | 3/2006 | Kouznetsov | |
| 7,077,045 | B2 * | 7/2006 | Dietrich et al. | 89/6 |
| 7,082,877 | B2 | 8/2006 | Jennings, III | |
| 7,086,334 | B2 | 8/2006 | Jennings, III | |
| 7,293,504 | B2 * | 11/2007 | Phelep et al. | 102/202.7 |
| 7,322,293 | B2 | 1/2008 | Kouznetsov | |
| 7,334,523 | B2 * | 2/2008 | Lucas et al. | 102/202.7 |
| 7,347,145 | B2 | 3/2008 | Teowee et al. | |
| 7,347,278 | B2 | 3/2008 | Lerche et al. | |
| 7,363,860 | B2 | 4/2008 | Wilson et al. | |
| 7,430,963 | B2 | 10/2008 | Hennings et al. | |
| 7,464,647 | B2 | 12/2008 | Teowee et al. | |
| 7,530,311 | B2 | 5/2009 | Koekemoer et al. | |
| 7,533,613 | B2 | 5/2009 | Kouznetsov | |
| 7,552,680 | B2 * | 6/2009 | Nance et al. | 102/202.7 |
| 7,581,496 | B2 | 9/2009 | Hennings et al. | |
| 7,587,977 | B2 * | 9/2009 | Broyer et al. | 102/202.11 |
| 7,714,240 | B1 * | 5/2010 | Roesler et al. | 200/181 |
| 7,866,264 | B2 | 1/2011 | Nance | |
| 7,921,774 | B1 * | 4/2011 | Reynolds et al. | 102/202.14 |
| 8,091,477 | B2 * | 1/2012 | Brooks et al. | 102/202.7 |
| 2002/0166472 | A1 * | 11/2002 | Goernig et al. | 102/202.5 |
| 2003/0221578 | A1 | 12/2003 | Forman et al. | |
| 2005/0016407 | A1 | 1/2005 | Bernard | |
| 2005/0030695 | A1 * | 2/2005 | Meyer et al. | 361/248 |
| 2005/0178282 | A1 * | 8/2005 | Brooks et al. | 102/202.7 |
| 2005/0217525 | A1 * | 10/2005 | McClure et al. | 102/311 |
| 2005/0235858 | A1 * | 10/2005 | Reynolds et al. | 102/202.14 |
| 2006/0011082 | A1 * | 1/2006 | Jacobson et al. | 102/200 |
| 2006/0027121 | A1 | 2/2006 | Koekemoer et al. | |
| 2006/0130693 | A1 | 6/2006 | Teowee | |
| 2006/0272536 | A1 * | 12/2006 | Lownds et al. | 102/215 |
| 2007/0099335 | A1 * | 5/2007 | Gangopadhyay et al. | 438/99 |
| 2007/0261584 | A1 * | 11/2007 | Nance et al. | 102/202.8 |
| 2008/0041260 | A1 | 2/2008 | Koekemoer et al. | |
| 2008/0060541 | A1 * | 3/2008 | Fujii et al. | 102/202.5 |
| 2008/0098921 | A1 * | 5/2008 | Labuschagne et al. | 102/202.5 |
| 2008/0134923 | A1 | 6/2008 | Lownds | |
| 2008/0148982 | A1 * | 6/2008 | Hennings et al. | 102/202.7 |
| 2008/0236432 | A1 * | 10/2008 | Teowee | 102/215 |
| 2008/0276819 | A1 * | 11/2008 | Desai et al. | 102/202.7 |
| 2009/0090263 | A1 * | 4/2009 | Han et al. | 102/322 |
| 2009/0151584 | A1 * | 6/2009 | Desai | 102/202.7 |
| 2010/0147175 | A1 * | 6/2010 | Christiansson et al. | 102/202.7 |
| 2010/0282105 | A1 * | 11/2010 | Neyer et al. | 102/202.1 |
| 2011/0072997 | A1 * | 3/2011 | Nance | 102/202.7 |
| 2012/0167792 | A1 * | 7/2012 | Schlenter | 102/217 |

FOREIGN PATENT DOCUMENTS

| | | | |
|---|---|---|---|
| WO | 2007/124539 | A1 | 11/2007 |
| WO | 2010/048587 | A1 | 4/2010 |

OTHER PUBLICATIONS

Notification Concerning Transmittal of International Preliminary Report on Patentability for PCT Application No. PCT/US2009/061961, mailing date of May 5, 2011; International Preliminary Report on Patentability, The International Bureau of WIPO, Geneva, Switzerland; and Written Opinion of the International Searching Authority, European Patent Office, Rijswijk, Netherlands.

Notification of Transmittal of the International Search Report and the Written Opinion of the International Searching Authority for PCT Application No. PCT/US2011/041003, mailing date of Sep. 22, 2011; International Search Report and Written Opinion of the International Searching Authority, European Patent Office; Rijswijk, Netherlands.

(56) References Cited

OTHER PUBLICATIONS

New Zealand Examination Report dated Sep. 25, 2012 for patent application serial No. 592333, filed Apr. 19, 2011, Battelle Memorial Institute, which is based on PCT/US2009/061961, filed on Oct. 23, 2009. The present U.S. application is also based on the same PCT application.

Chilean Patent Office Action for Chile Patent Application No. 00900-2011, filed Apr. 20, 2011 (based on PCT/US2009/061961, filed on Oct. 23, 2009), see in particular page two.

New Zealand Further Examination Report dated Jan. 24, 2014 for patent application serial No. 592333, filed Apr. 19, 2011, Battelle Memorial Institute, which is based on PCT/US2009/061961, filed on Oct. 23, 2009.

* cited by examiner

ELECTRONIC DETONATOR SYSTEM

CROSS REFERENCE TO RELATED APPLICATIONS

This application is a continuation of U.S. patent application Ser. No. 13/091,707, filed Apr. 21, 2011, entitled "ELECTRONIC DETONATOR SYSTEM", now allowed, which is a continuation of International Application No. PCT/US2009/061961, filed Oct. 23, 2009, entitled "ELECTRONIC DETONATOR SYSTEM", which claims the benefit of U.S. Provisional Patent Application Ser. No. 61/108,277, filed Oct. 24, 2008, entitled "ELECTRONIC DETONATOR SYSTEM", the disclosures of which are hereby incorporated by reference.

BACKGROUND

The present invention relates in general to detonators, and in particular, to electronic detonators that integrate a high voltage switch, an initiator and a fireset.

In various industries, such as mining, construction and other earth moving operations, it is common practice to utilize detonators to initiate explosives loaded into drilled blastholes for the purpose of breaking rock. In this regard, commercial electric and electronic detonators are conventionally implemented as hot wire igniters that include a fuse head as the initiating mechanism to initiate a corresponding explosive. Such hot wire ignitors operate by delivering a low voltage electrical pulse, e.g., typically less than 20 volts (V), to the fuse head, causing the fuse head to heat up. Heat from the fuse head, in turn, initiates a primary explosive, e.g., lead azide, which, in turn, initiates a secondary explosive, such as pentaerythritol tetranitrate (PETN), at an output end of the detonator. In this regard, conventional hot wire igniters cannot directly function a high density secondary explosive and must rely on an extremely sensitive primary explosive to transition the detonation process from the fuse head to a corresponding explosive output pellet. Typically, the firing voltage of hot wire igniters is less than 20 V, the required current is less than 10 amps and the peak power needed to function the detonator is less than 10 watts. As such, it is possible that the voltage and power requirements to function this type of detonator may be encountered from inadvertent sources like static, stray currents and radio frequency (RF) energy.

An electric detonator that serves as an alternative to the hot wire initiator based detonator was developed in the 1940's for military purposes and now has found civilian use for energetics research. This exemplary detonator is known as an exploding bridgewire detonator (EBW), which includes a short length of small diameter wire that functions as a bridge. In use, explosive material beginning at a contact interface with the bridgewire transitions from a low density secondary explosive to a high density secondary explosive at the output end of the detonator. The secondary explosive is normally PETN or cyclotrimethylene trinitramine (RDX). Like conventional hot wire intiators, an EBW cannot directly initiate a high density secondary explosive. To initiate a detonation event, a higher voltage pulse, e.g., typically, a threshold of about 500 V, is applied in an extremely short duration across the bridgewire causing the small diameter wire to explode. The power needed to function this type of detonator is in the kilowatts range. The shockwave created from the bridge wire's fast vaporization initiates the low density pellet, which in turn initiates the high density secondary explosive pellet at the output end of the EBW.

Another exemplary detonator type utilizes an exploding foil initiator (EFI). A conventional EFI includes a thin metal foil having a defined narrow section, and a polymer film layer is provided over the metal foil. A pellet of explosive material is spaced from the polymer film layer by a barrel having an aperture there through. The barrel is positioned over the thin metal foil such that the barrel aperture is aligned with the defined narrow section. To initiate a detonation event, a high voltage, very short pulse of energy is applied across the metal foil to cause the narrow section of the metal foil to vaporize. As the narrow section of the metal foil vaporizes, plasma is formed as the vaporized metal cannot expand beyond the polymer film layer. The pressure created as a result of this vaporization action builds until the polymer film layer is compromised. Particularly, the pressure causes a flyer disk to release e.g., to bubble, shear off or otherwise tear free from the polymer layer. The flyer disk accelerates through the aperture in the barrel and impacts the pellet of explosive material. The impact of the pellet by the flyer imparts a shock wave that initiates the detonation of the pellet and any connected explosive device.

BRIEF SUMMARY

According to various aspects of the present invention, an electronic detonator is provided. The detonator comprises a detonator housing that integrally packages a chip having a high voltage switch and an initiator, an initiating pellet, a primary energy source, a secondary energy source, and a controller. The high voltage switch includes a first switch contact and a second switch contact. The switch also includes a first trigger contact, a second trigger contact, and a trigger element electrically coupled between the first trigger contact and the second trigger contact. Here, the trigger element positioned between, and is electrically isolated from the first and second switch contacts. Moreover, the trigger element is shaped as a repeating pattern of faceted sections that narrow in width and funnel out in width between the first and second switch contacts.

The initiator includes a first initiator pad and a second initiator pad, the second initiator pad is electrically connected in series to the first switch contact of the high voltage switch. The initiating pellet is positioned relative to the initiator such that functioning of the initiator causes detonation of the initiating pellet. The controller is operatively configured to function the initiator to detonate the initiating pellet by causing a desired primary charge potential generated by the primary energy source to be applied between the first initiator pad and the second switch contact and by applying a desired secondary charge potential generated by the secondary energy source to be applied between the first trigger contact and the second trigger contact so as to close the high voltage switch.

According to further aspects of the present invention, an electronic detonator is provided. The electronic detonator comprises a generally puck shaped detonator housing having at least one through tunnel that extends through the puck. Moreover, the detonator housing integrally packages a chip having a high voltage switch and an initiator, an initiating pellet, a primary energy source, a secondary energy source, a controller, and an inductor proximate to a select one of the through tunnels. The high voltage switch includes a first switch contact and a second switch contact. The switch also includes a first trigger contact, a second trigger contact, and a trigger element that is electrically coupled between the first trigger contact and the second trigger contact. The trigger element is positioned between and is electrically isolated from the first and second switch contacts. Moreover, the trigger element is shaped as a repeating pattern of faceted sections that narrow in width and funnel out in width between the first and second switch contacts. Additionally, the initiator includes a first initiator pad and a second initiator pad, where the second initiator pad is electrically connected in series to the first switch contact of the high voltage switch.

Further, the initiating pellet is positioned relative to the initiator such that functioning of the initiator causes detonation of the initiating pellet. Yet further, the inductor is coupled to the controller of the detonator as an inductive pickup for wireless communication with an external source, where the inductive pickup receives a command to instruct the controller to function the initiator to detonate the initiating pellet by causing a desired primary charge potential generated by the primary energy source to be applied between the first initiator pad and the second switch contact and by applying a desired secondary charge potential generated by the secondary energy source to be applied between the first trigger contact and the second trigger contact so as to close the high voltage switch.

According to still further aspects of the present invention, a system is provided for performing blasting operations. The system comprises a plurality of hole controllers, where each hole controller is provided for positioning at a corresponding blast hole in a corresponding blast site. The system also includes at least one detonator for each blast hole that is in communication with the corresponding hole controller associated with that blast hole. Each detonator has a detonator housing that integrally packages a chip having a high voltage switch and an initiator, an initiating pellet, a primary energy source, a secondary energy source, communications circuitry for communicating with the associated hole controller and a detonator controller. In this manner, the high voltage switch includes a first switch contact and a second switch contact. The high voltage switch also includes a first trigger contact, a second trigger contact, and a trigger element that is electrically coupled between the first trigger contact and the second trigger contact. The trigger element is positioned between, and is electrically isolated from the first and second switch contacts. Also, the trigger element is shaped as a repeating pattern of faceted sections that narrow in width and funnel out in width between the first and second switch contacts. Also, the initiator includes a first initiator pad and a second initiator pad. The second initiator pad is electrically connected in series to the first switch contact of the high voltage switch.

The initiating pellet is positioned relative to the initiator such that functioning of the initiator causes detonation of the initiating pellet. Further, the controller is operatively configured to function the initiator to detonate the initiating pellet by causing a desired primary charge potential generated by the primary energy source to be applied between the first initiator pad and the second switch contact and by applying a desired secondary charge potential generated by the secondary energy source to be applied between the first trigger contact and the second trigger contact so as to close the high voltage switch.

The system still further includes a shot controller for wireless communication with each of the hole controllers and a blasting computer that communicates with the shot controller for coordinating a blast event. The blasting computer is operatively configured to obtain data from each of the detonators via their corresponding hole controller and the shot controller and calculate a firing solution. In response thereto, each detonator is automatically programmed with a corresponding detonation time based upon the calculated firing solution. Moreover, the blasting computer is configured to initiate an arm sequence, wherein the controller of each detonator charges the primary energy source to a desired primary charge potential, wherein the high voltage switch holds off the primary charge potential from functioning the initiator while the detonator is armed. In response thereto, the blasting computer receives a confirmation that each detonator is armed and ready to fire and initiates a blast command after acknowledging that detonators are armed to function the initiator at the corresponding programmed detonation time.

BRIEF DESCRIPTION OF THE SEVERAL VIEWS OF THE DRAWINGS

The following detailed description of various aspects of the present invention can be best understood when read in conjunction with the following drawings, where like structure is indicated with like reference numerals, and in which.

DETAILED DESCRIPTION

According to various aspects of the present invention, an electronic detonator includes in general, at least one high voltage switch and at least one initiator. The detonator further implements an actuation system having a trigger procedure that requires at least two trigger conditions that must be satisfied to initiate a detonation event in a corresponding explosive device. Particularly, the trigger procedure must be sufficient to actuate at least one high voltage switch, and the trigger procedure must be sufficient to actuate at least one initiator, in order to trigger the desired detonation event, as will be described in greater detail herein. Moreover, as will be described in greater detail herein, the detonator includes an integral fireset that provides the high voltage energy source(s) necessary to function both the high voltage switch(es) and the initiator(s) within the detonator.

Figure 1:
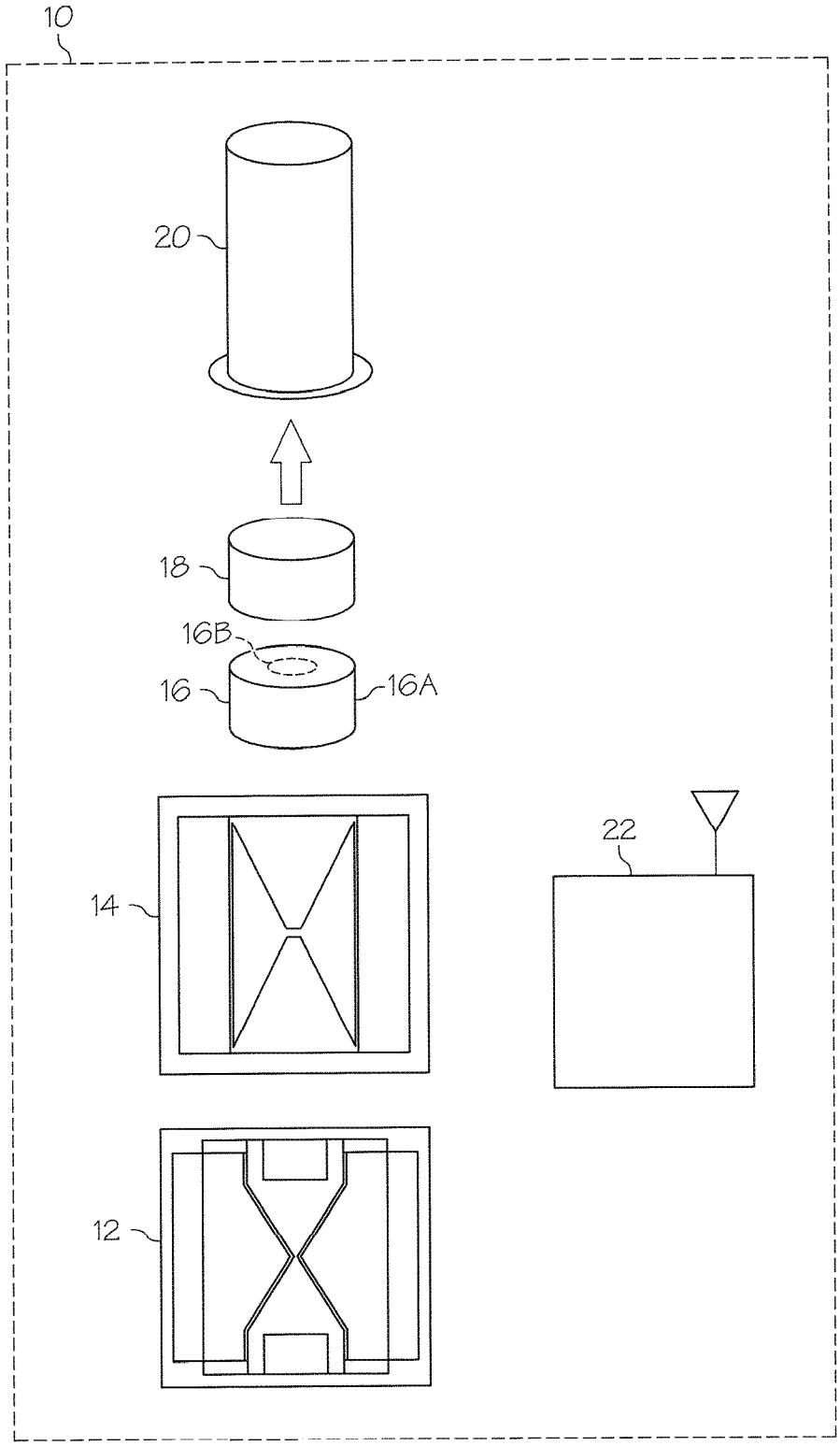
FIG. 1 is a schematic diagram illustrating several components of a detonator according to various aspects of the present invention.

Referring now to the drawings and in particular to FIG. 1, a detonator 10 is schematically illustrated according to various aspects of the present invention. The illustrated detonator 10 includes in general, a high voltage switch 12 that is in a normally open state, which is electrically connected in series with an initiator 14. Moreover, the detonator 10 includes an initiating pellet 16 that is in cooperation with the initiator 14. To trigger the initiating pellet 16, the high voltage switch 12 must be actuated to transition the high voltage switch 12 from a normally open state to a closed state. Once the high voltage switch 12 is closed, the initiator 14 may be operated (also referred to herein as "functioned") to detonate the initiating pellet 16. Detonation of the initiating pellet 16, which is implemented as a high density, insensitive secondary explosive), is utilized to detonate another explosive device or product that is positioned proximate to the detonator 10.

The detonator 10 may also include further components, such as an additional explosive pellet 18, e.g., an output pellet that is comprised of an insensitive secondary explosive with a very high shock output. This output pellet acts as a built in booster for the detonator 10, allowing direct initiation of very insensitive explosive devices and blasting agents. Moreover, the detonator 10 may be packaged in a detonator shell 20 for housing the various detonator components. According to aspects of the present invention, the high voltage components, including the high voltage switch 12 and the initiator 14 may be miniaturized to fit inside standard detonator dimensions, thus the detonator shell 20 can take on a conventional size, form factor and/or overall appearance. Alternatively, the detonator shell 20 may utilize a customized size, shape, etc. Still further, as will be described in greater detail herein, the detonator 10 may comprise further components 22, such as induction based communication capabilities and powering electronics, an onboard controller having a microprocessor, communications, a low voltage to high voltage fireset, a global positioning system (GPS), an identification system, such as using radio frequency identification (RFID) technology and/or other systems for facilitating efficient deployment of the detonator 10 in the field, as will be described in greater detail herein. Such additional components 22 are configured to also fit within the detonator shell 20 providing an integrated detonation system.

In an exemplary operation of the detonator 10, the trigger procedure may comprise actuating the high voltage switch 12 a prescribed time before functioning the initiator 14, e.g., to create a conductive path that "arms" the initiator 14. Alternatively, the trigger procedure may operate both the high voltage switch 12 and the initiator 14 in a single operation. For example, a circuit that supplies a signal to the initiator 14 may be "charged" and ready for operation such that, upon actuation of the high voltage switch 12, the closure of the high voltage switch 12 enables the previously charged signal to trigger the initiator 14. Exemplary configurations of the detonator 10 are described in greater detail herein.

By way of illustration and not by way of limitation, the additional circuitry 22 of the detonator 10 may include a primary energy source, a secondary energy source, a controller, and a low voltage to high voltage converter. The low voltage to high voltage converter is controlled, e.g., by the controller, to convert a low voltage to a high voltage sufficient to charge the primary energy source. Moreover, in this illustration, the detonator 10 includes a primary circuit that electrically connects the primary energy source to a series circuit that connects the high voltage switch in series with the initiator.

The controller performs a detonation action by receiving a request to arm the detonator. To "arm" the detonator 10, the controller controls the low voltage to high voltage converter to charge the primary energy source to a desired primary charge potential. Notably, the high voltage switch holds off the primary charge potential from functioning the initiator while the detonator is armed. The controller also charges the secondary energy source to a desired secondary charge potential. The controller may charge the secondary source, for example, after acknowledging that the primary energy source is at the desired primary charge potential. The controller may thus function the initiator by electrically closing the high voltage switch, thus allowing the primary charge potential to function the initiator to detonate the initiating pellet.

The High Voltage Switch

The high voltage switch 12 may be implemented as a high voltage (HV) switch chip, and may be manufactured utilizing a Metallic Vacuum Vapor Deposition (MVVD) process. In an exemplary implementation of the detonator 10, the high voltage switch 12, e.g., produced using an MVVD process, provides an additional circuit that is required to be charged and triggered independent of charging and functioning the initiator 14, to initiate a detonation event to fire the detonator 10. Particularly, the high voltage switch 12 of the detonator 10 is designed to hold off stray signals from triggering the initiator 14, e.g., signals that are not valid actuation signals, even if the stray signals are themselves, relatively high voltage signals. In this regard, the high voltage switch 12 is triggered by an actuation signal comprising a voltage that is significantly greater than the voltage associated with common electronic components that may be proximate to the detonator, thus providing a level of redundancy to the detonator 10, as will be described in greater detail herein.

According to various aspects of the present invention, the high voltage switch 12 described more fully herein, may also find use in modifying the actuation signal required to operate existing hot wire based igniters. The firing voltage, amperage, and peak power required to fire a hot wire, and EBW, or an EFI detonator are separated by orders of magnitude. Hot wire igniters function with as little as 5 volts to 12 volts of electrical potential, a single amp of firing current and a few watts of peak power, making such devices susceptible to stray currents and inadvertent power sources. As a point of contrast, an EBW requires hundreds of volts, hundreds of amps and kilowatts of peak power to function, while an EFI typically requires at least 1,000 volts, thousands of amps and megawatts of peak power to function.

As an example, the high voltage switch 12 may be implemented as an MVVD switch chip that is installed in-line with a hot wire igniter such that the threshold voltage required to function the igniter is raised significantly. In this regard, the high voltage switch 12 according to various aspects of the present invention, may be wired in series with the hot wire based igniter to raise the minimum firing voltage of the hot wire based igniter by orders of magnitude, e.g., (in round numbers) 10 V to 1 kV, depending upon the specific implementation and tuning of the MVVD switch, raising immunity of the device to unwanted electrical stimuli. As such, various aspects of the present invention may find application not only in an EFI based system, but also in technologies that utilize a commercial detonator, and even an air bag igniter.

The Initiator

According to aspects of the present invention, the initiator 14 may comprise an EFI, e.g., which may also be manufactured utilizing a Metallic Vacuum Vapor Deposition (MVVD) process. The MVVD process allows EFI-based initiators to be fabricated, which exhibit improved timing accuracy of the detonator 10 over conventional detonator devices. Regardless, the high voltage switch 12 and the initiator 14 may be co-located, e.g., provided on a single integrated circuit (IC) chip. Alternatively, the high voltage switch 12 and the initiator 14 may be provided separately within the detonator shell 20, e.g., on separate IC chips or other suitable substrates that are electrically interconnected together.

The EFI-based initiator 14 according to various aspects of the present invention, converts a specialized, high peak power electrical pulse, (e.g., in the megawatts), delivered to the initiator 14 by an appropriate energy source via actuation of the high voltage switch 12, into plasma energy sufficient to detonate the corresponding initiating pellet 16. Particularly, the plasma energy provided by the initiator 14 is utilized to propel an object, e.g., a hypervelocity, polyimide flyer directly into the initiating pellet 16, which causes the explosive material in the initiating pellet 16 to explode. Operation of the EFI-based initiator 14 will be described in greater detail herein.

The Initiating Pellet

According to aspects of the present invention, the initiating pellet 16 is void of a primary explosive material. Rather, the initiating pellet 16 comprises an insensitive secondary explosive material or materials. That is, the initiating pellet 16 may be implemented as either a single or combination pellet. In an illustrative implementation, a single pellet 16 comprises Hexanitrostilbene (HNS-IV). As another example, a combination pellet may include two components, 16A and 16B. By way of illustration, the initiating pellet 16 may include HNS-IV, at least in an area 16B of anticipated impact from an EFI-based initiator 14. The remaining explosive 16A in a combination pellet comprises a high brisance, insensitive secondary explosive such as Composition A5, PBXN-5, etc., that possesses considerably more shock energy than HNS-IV alone. For example, where the initiator 14 comprises an EFI-based initiator, an initiating pellet 16 may be generally cylindrical in shape, and comprise a dot of HNS-IV in the bottom center 16B of its cylinder form where a flyer from the EFI-based initiator 14 will impact, and the remaining explosive portion 16A of the initiating pellet may comprise PBXN-5. The combination of HNS-IV and a high brisance secondary provides combined insensitive explosives that are much less sensitive than those found in conventional commercial detonators, making the detonator 10 according to various aspects of the present invention, suitable for in line use in military fuses (MIL-STD-13 16E).

Comparatively, in a typical application for the commercial blasting industry, a hot wire based conventional electronic detonator (non-electronic) sets off an explosion by functioning a fusehead or bridge in response to a low voltage signal, to ignite an ignition mixture covering the fuse or bridge. This ignition sets off a pyrotechnic delay train (electric delay detonators only) that initiates a pellet of a sensitive primary explosive such as lead azide or lead styphnate. Newer hot wire based (fusehead) commercial electronic detonators replace the pyrotechnic delay train with a microprocessor that commands a capacitor to function the fuse head at a preprogrammed time. However, the voltage/current/peak power profiles are still low and this version of the electronic detonator still requires a sensitive primary explosive to initiate a sensitive secondary explosive. Such primary explosives are extremely sensitive to shock, friction, and/or static electricity. Initiation of the sensitive primary explosive is utilized to detonate a sensitive secondary explosive output pellet that is typically implemented using an explosive such as PETN (pentaerythritol tetranitrate). Such a secondary explosive is sensitive and is not approved for in-line use by MIL-STD-13 16E.

That is, conventional commercial detonators utilize direct coupling of their fusehead to a very sensitive, lead based primary and then to a sensitive secondary in their explosive train. For a fused munition, this conventional train type may require a mechanical explosive train interrupter with two independent and separate features that lock the detonator into a non-active position where the sensitivity and propensity of such a conventional explosive train create the potential for the conventional detonator to function inadvertently.

To the contrary, according to various aspects of the present invention, the detonator 10 provides a system that eliminates the need for extremely sensitive primary and sensitive secondary explosives. Rather, the explosives that are utilized are insensitive explosives. Performance attributes according to various aspects of the present invention may comprise potentially increased resistance to transient pressure pulses, increased reliability, and increased accuracy. Such a detonator configuration may also find use in the research industry where EBWs are now used.

The detonator according to still further aspects of the present invention improves operation even over conventional EBWs. For example, the EFI-based electronic detonator 10 according to aspects of the present invention is configurable to offer improved simultaneity for applications requiring multiple initiation points, and built in programmable, high accuracy timing for applications requiring varying initiation times, as will be described in greater detail below.

Micro-Fabricated Switch and Initiator

Figure 2:
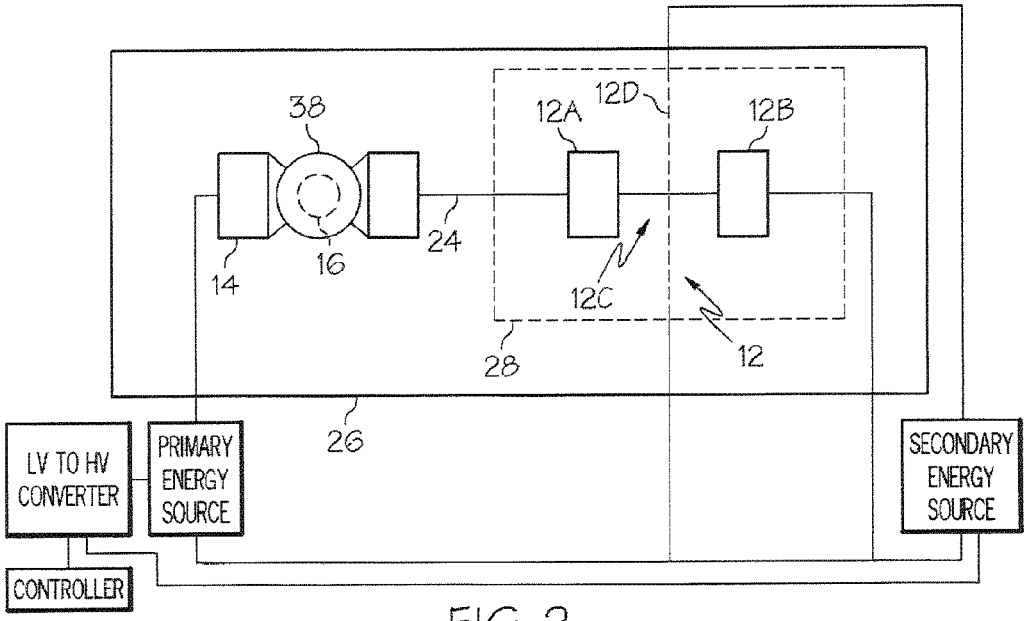
FIG. 2 is a schematic illustration of a high voltage switch and an initiator according to various aspects of the present invention.

According to various aspects of the present invention, micro-fabrication techniques may be utilized to integrate the high voltage switch 12 with the initiator 14 onto a ceramic or silicon substrate. Micro-fabrication provides a platform to reduce cost and/or volume/size of the detonators 10. Referring to FIG. 2, according to various aspects of the present invention, the high voltage switch 12 may be implemented as a planar switch connected to the initiator 14, e.g., an Exploding Foil Initiator (EFI), Exploding Bridgewire Initiator (EBW), standard fusehead detonators (hotwire) or Semiconductor Bridge (SCB) Initiator.

The initiator 14 is separated from the high voltage switch 12 by a board trace or wire 24 such that the high voltage switch 12 and the initiator 14 are two separate components on the same board or chip 26. An insulating material 28, e.g., a polymide film such as Kapton, may be provided over or otherwise between the high voltage switch 12 and optionally, the trigger wire 24 or portions thereof (as shown as the dashed box) and the initiator 14. Kapton is a trademark of E.I. du Pont de Nemours and Company. The insulating material 28 allows the high voltage switch 12 to hold off a high voltage and improves reliability of the high voltage switch 12 by providing a tighter tolerance to the hold off voltage and/or to the voltage required to close the switch contacts relative to a conventional gap, e.g., found in a conventional spark gap device.

According to various aspects of the present invention, the high voltage switch 12 includes a first contact 12A and a second contact 12B that define the switch contacts, which are separated from each other by a gap 12C. Additionally, a trigger element 12D is disposed within the gap 12C between the first contact 12A and the second contact 12B. The trigger element 12D may comprise, for example, a wire or trace that is imbedded between the first contact 12A and second contact 12B, as schematically represented by the dashed line. The geometric shape of this trace is also important in determining the voltage holdoff, triggering voltage, and repeatability of the structure for purposes of fabrication. For instance, the trigger element may be defined by a faceted geometry described in greater detail with reference to FIG. 7. In its default state, the trigger element 12D is electrically isolated from the first contact 12A and the second contact 12B. Moreover, in its default state, the first contact 12A and second contact 12B are electrically isolated from one another, forming an open circuit there between.

To close or otherwise activate the high voltage switch 12, an energy source is utilized to drive a current through the trigger element 12D that is sufficient to electrically connect the first contact 12A and 12B. For instance, switch closure may result from breaking down the dielectric that separates the first and second switch contacts 12A and 12B from the trigger element 12D. Alternatively, the trigger element may short the first and second switch contacts 12A, 12B as a result of vaporization, melting or otherwise passing current through the trigger element 12D.

In an illustrative example, an actuation signal required to operate the high voltage switch 12 triggers a low voltage to high voltage DC-DC converter to charge an energy source such as a high voltage capacitor. Discharging the capacitor drives the necessary current through the trigger element 12D in such a way that the first and second contacts 12A, 12B short together, thus closing the high voltage switch 12.

In another illustrative example, to close or otherwise activate the high voltage switch 12, a primary energy source in a primary circuit is applied across the first contact 12A and second contact 12B of the high voltage switch 12. For example, a primary energy source implemented as a primary capacitor may be charged to a high voltage, e.g., 1,000 volts or greater. The potential of the primary capacitor may be coupled to the first contact 12A, e.g., through the initiator 14. The second contact 12B may be referenced to ground or other reference associated with the primary energy source. Because the first contact 12A is electrically isolated from the second contact 12B, no current will flow between the first contact 12A and second contact 12B, and thus, no current flows through the initiator 14. However, because of a potential difference between the first contact 12A and second contact 12B, an electric field is formed with sufficient strength to cause ions to migrate towards the gap 12C. Additionally, a secondary energy source in a secondary circuit is utilized to drive a current through the trigger element 12D that is sufficient to cause the migrating ions to arc across the gap 12C and create a conductive path between the first contact 12A and the second contact 12B.

The secondary energy source may receive its voltage, for example, by bleeding down voltage from the primary energy source, or the secondary energy source may utilize its own low voltage to high voltage converter to generate the necessary signal required to close the high voltage switch 12. Further, an electronic switch such as a field effect transistor may be controlled by a suitable control signal from the controller to selectively couple the secondary energy source to the trigger element 12D. In this regard, the electronic switch may be positioned on the low voltage side, e.g., before a low voltage to high voltage converter, or the electronic switch may be positioned between the secondary energy source and the trigger electrode 12D.

According to various aspects of the present invention, the high voltage switch 12 may be configured to hold off the high voltage required to function the initiator 14. For example, the initiator 14 may be implemented as a single exploding foil initiator (EFI) that requires a high voltage to actuate. Moreover, the initiator 14 may be implemented as an array of EFIs, which require relatively higher voltages than even a single EFI to fire. In this regard, the characteristics of the high voltage switch(es) 12 and/or initiator(s) can be custom microfabricated according to the various requirements of the associated with the detonator 10.

Comparatively, in certain applications, conventional MOS Controlled Thyristor (MCT) devices may be utilized as electronic switches. However, a conventional MCT has an upper end hold off voltage limit of approximately 3 kilovolts (kV), which is a limiting factor in the practicality of MCTs for use with the detonator 10 according to certain aspects of the present invention. For example, the initiator 14 may comprise a multi-point EFI array that requires as high as 6 kV to reliably fire all of the EFI units in the EFI array.

Figure 3:
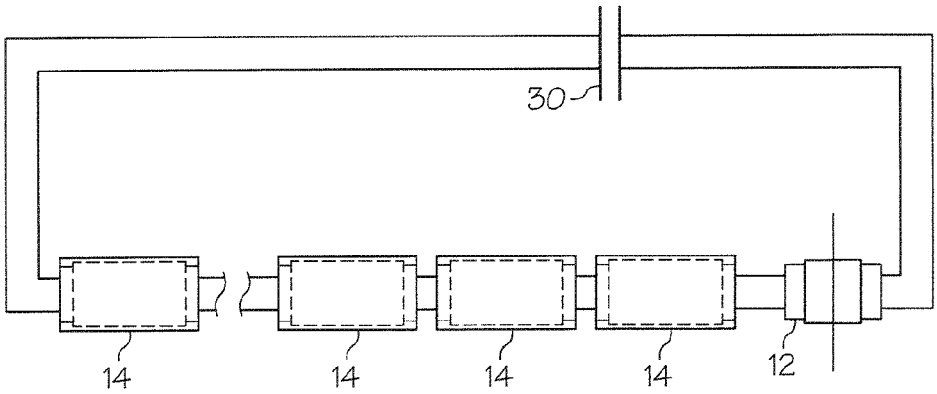
FIG. 3 is a schematic illustration of a high voltage switch and a plurality of initiators that may be packaged into a detonator, according to various aspects of the present invention.
Figure 4:
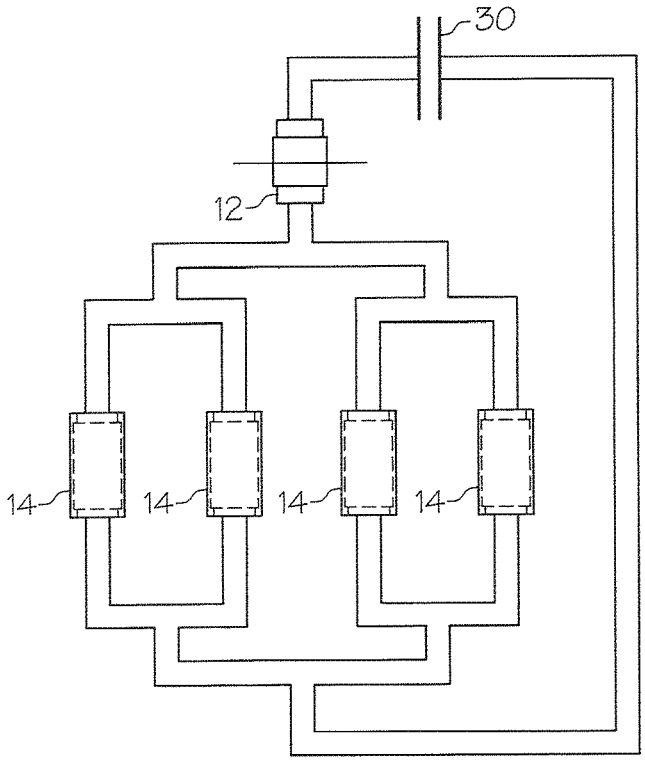
FIG. 4 is a schematic illustration of a high voltage switch and a plurality of initiators that may be packaged into a detonator, according to further aspects of the present invention.
Figure 5:
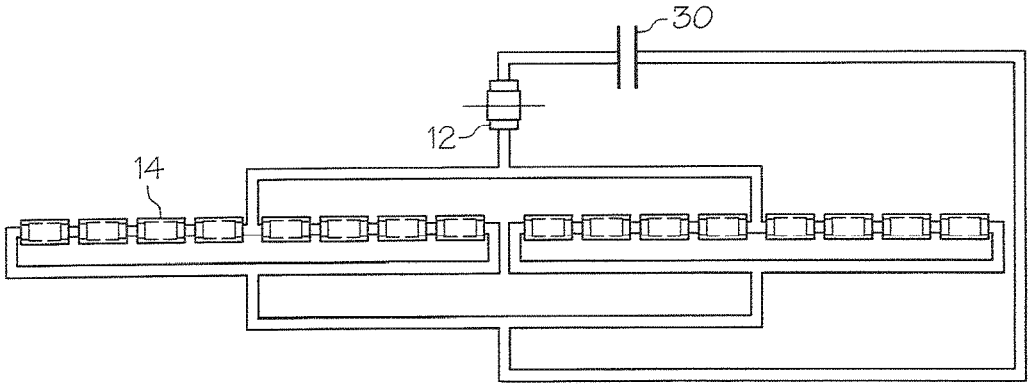
FIG. 5 is a schematic illustration of a high voltage switch and a plurality of initiators that may be packaged into a detonator, according to still further aspects of the present invention.

However, according to still further aspects of the present invention, the high voltage switch 12 is independently used to function multiple initiators 14, e.g., multiple EFIs in series, e.g., as illustrated in FIG. 3, in parallel, as illustrated in FIG. 4 or in series and parallel circuits as illustrated in FIG. 5. In this regard, the high voltage switch 12 and multiple initiators 14 may be implemented on the same chip. In FIGS. 3-5, the high voltage switch 12 and multiple initiators 14 are functioned in response to a signal from a single capacitor 30 for purposes of illustration. Moreover, the secondary energy source used to trigger the high voltage switch 12 is not illustrated for purposes of clarity of discussion, but the separate trigger element to close the high voltage switch 12 is schematically represented by the line through the high voltage switch 12.

Further, a conventional MCT switch is very expensive. Still further, conventional MCT devices will trigger in response to relatively low voltage signals, e.g., potentially less than 50 volts, making conventional MCT devices potentially susceptible to triggering from inadvertent voltage sources. Comparatively, the high voltage switch 12, according to various aspects of the present invention, is tailored to require an energy signal requiring power greater than anticipated stray signals.

Figure 6:
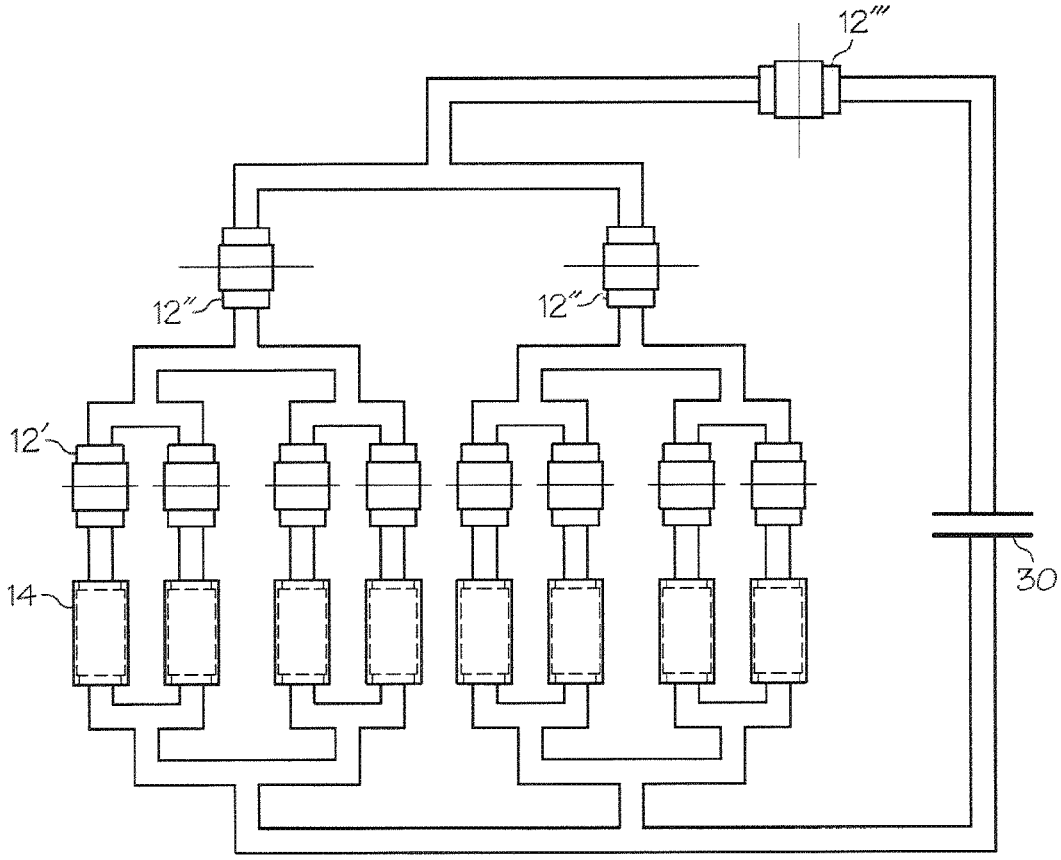
FIG. 6 is a schematic illustration of a plurality of high voltage switches and a plurality of initiators that may be packaged into a detonator, according to various aspects of the present invention.

Referring to FIG. 6, the detonator 10 may include multiple high voltage switches 12, such as may be useful for warhead applications or other applications where programmability is desired. For example, by way of illustration and not by way of limitation, a high voltage switch 12' is associated with a corresponding series initiator 14 to define an array of initiator branches. Additionally, a high voltage switch 12" is assigned to every four branches, which are further arranged in pairs of initator branches. Still further, a high voltage switch 12'" is assigned to every two high voltage switches 12". As such, multiple high voltage switches 12 may be utilized to enable and/or disable one or more initiators, e.g., in an array of initiators 14 thus providing programmable control of a multipoint initiator array.

The arrangement as illustrated in FIG. 6 may utilize alternative configurations, e.g., employ a higher number of high voltage switches 12 to control individual branches, nodes, or discrete initiators 14. As an illustrative example, individual high voltage switches controlling an individual or group of initiators 14 may be fired ahead of time to establish a conductive path to the initiators that are to be functioned. Other discrete or groups of initiators 14 that are not to be fired can remain un-triggered, holding off the firing voltage and preventing current flow to these units. The main high voltage switch, e.g., 12''' would then be triggered when the warhead is commanded to detonate, and the pre-fired or un-triggered switches would direct the current down the traces to the initiators commanded to fire. This configuration allows virtually infinite programmable enabling/disabling of a network of initiators 14, even on the fly.

The switch structure described with reference to FIG. 2 may be applied to any of the switch implementations in FIGS. 3-6. For instance, the insulating material 28 provided over the micro-fabricated switch components and optionally, the trigger wire 24 or portions thereof, may be utilized to facilitate a small structure configured or otherwise custom tailored to the large hold off voltages necessary to fire multiple initiators 14. In this regard, various aspects of the present invention provide distinct size and voltage holdoff advantages when compared to conventional electrical switches.

Figure 7:
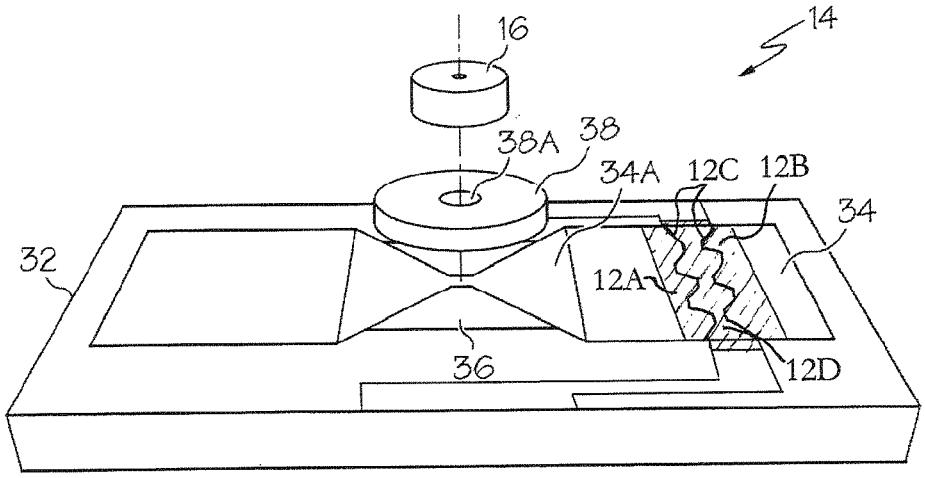
FIG. 7 is a schematic illustration of an initiator according to various aspects of the present invention.

Referring to FIG. 7, as noted in greater detail herein, the initiator 14 may be implemented as an EFI. In an illustrative implementation, the EFI-based initiator 14 includes an alumina substrate 32 that forms a base layer. A bridgefoil 34 having a narrow channel 34A is provided on the alumina substrate 32. Moreover, the bridgefoil 34 is electrically coupled to an energy source, e.g., a high voltage capacitor, via the switch 12 (described in greater detail with reference to FIG. 3). A flyer layer 36, e.g., a polyimide film material such as Kapton is positioned over at least the narrow channel 34A of the bridgefoil 34, and a barrel 38 is positioned over the Kapton flyer layer 36. The barrel 38 includes a through aperture 38A. The barrel 38 may comprise, for example, a polyimide film material such as Kapton. As noted above, Kapton is a trademark of E.I. du Pont de Nemours and Company. When the detonator 10 is assembled, the barrel 38 is positioned proximate to the initiating pellet 16. Referring briefly back to FIG. 2, the flyer layer 36 and the barrel 38 may be formed as part of the micro-fabrication of the initiator 14, e.g., directly deposited onto the EFI chip during the fabrication process. As such, although illustrated as separate components for purposes of illustration, the barrel 38 may be integrated with the flyer layer 36, bridgefoil 34 and substrate 32.

In operation, when the bridgefoil 34 is vaporized in response to a suitable initiation signal, a disk is cut from the flyer layer 36 within the area under the through aperture 38A of the barrel 38. The disk is directed at a high velocity along the through aperture 38A of the barrel 38 so as to impact the initiation pellet 16. The impact of the disk with the initiating pellet 16 sets of the designed explosion.

EFI-based initiators require typical operational voltages of 800 V to 2,000 V. The peak power required to launch the flyer with sufficient momentum to initiate the impacted explosives is in the megawatts range. However, an EFI can directly initiate a high density, insensitive secondary explosive. Thus, no extremely sensitive primary or sensitive low density secondary explosives are required for this initiation technology.

As further illustrated, according to various aspects of the present invention, the high voltage switch 12 may be integrated onto the same base substrate as the initiator. For instance, as illustrated, the first contact 12A of the high voltage switch 12 is in series with the initiator 14. The second contact 12B of the high voltage switch 12 couples the high voltage switch 12 to the primary circuit. The trigger element 12D is formed between the first and second contacts 12A, 12B and has a faceted geometry that spaces the trigger element 12D from the first contact 12A and the second contact 12B. For instance, as illustrated, the faceted configuration of the trigger element 12D comprises a repeating pattern of a widened portion of the switch adjacent to a narrowed portion of the switch. The pattern of the trigger element 12D may also and/or alternatively be implemented as a repeating row of butterfly banded regions where the width of the trigger element repeatedly narrows into a channel shape, then funnels out to a wider shape. The pattern of the trigger element 12D may also be serpentine, saw toothed, ramped jagged or otherwise configured to achieve a desired hold off voltage.

In the illustration, the thickness of the lines that define the boundary between the first contact 12A and the trigger element 12D, and the boundary between the second contact 12B and the trigger element 12D defines the gap 12C. A dielectric material may be used to fill the gap 12C and/or to generally overlie the switch components 12A, 12B, 12C, 12D e.g., as schematically represented by the illustrated shading in the exemplary implementation. A pair of switch lands, seen to the right and left of the high voltage switch 12, enable coupling of the secondary energy source to the trigger element 12D of the high voltage switch 12.

Figure 8:
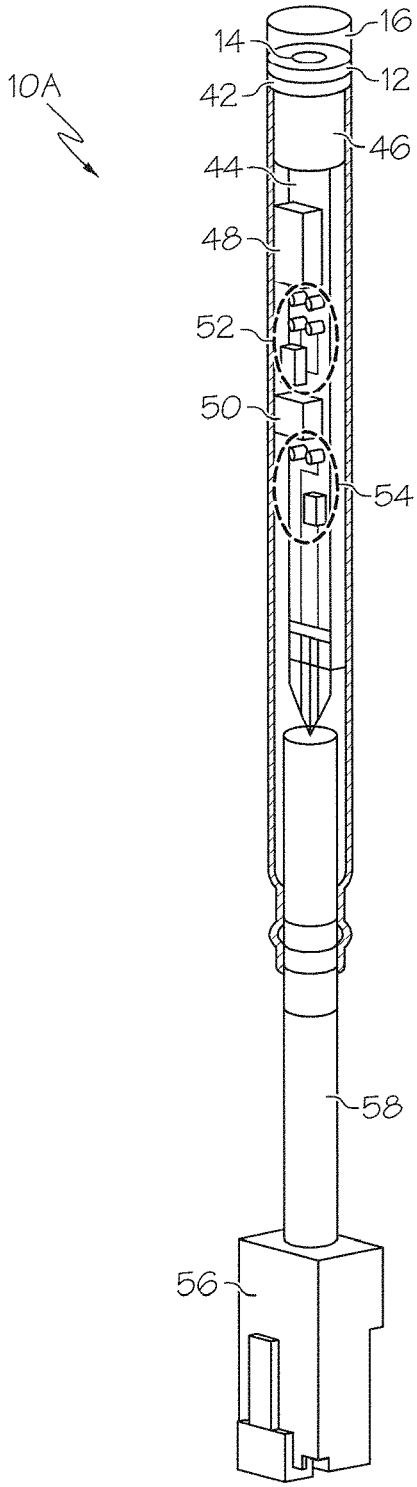
FIG. 8 is a schematic illustration of a detonator according to various aspects of the present invention.

Referring to FIG. 8, a schematic view illustrates a detonator 10, further designated 10A, according to various aspects of the present invention. The electronic detonator 10A is provided in a standard cap configuration and comprises a high voltage switch 12, e.g., implemented as a high voltage switch chip, an initiator 14, e.g., as implemented by an EFI, 12, an initiating pellet 16. The high voltage switch 12, initiator 14 and the initiating pellet 16 may be implemented using any of the techniques as described more fully herein. The detonator 10A also includes a header assembly 42, printed circuit board (PCB) to socket connections 44, a header socket 46, a primary energy source 48, such as a primary high voltage capacitor, a secondary energy source 50, such as a secondary capacitor (also referred to herein as a switch capacitor), a controller 52, e.g., which may include a control electronics such as a microprocessor, timing circuitry, switching circuitry, diagnostic circuitry, bleed down components, etc. The detonator 10A may also comprise a low voltage to high voltage converter 54 and a detonator connector 56 coupled and arranged to the detonator 10, e.g., via a suitable connecting cable 58, as illustrated. Still further, the detonator 10A may include RFID technology, position determining technology such as GPS, communications capabilities, a timer or other timing system and other miscellaneous control electronics.

With reference to FIGS. 2, 7 and 8, a primary circuit is formed, which electrically connects the primary energy source 48 to a series circuit that connects the high voltage switch 12 in series with the initiator 14, e.g., via wiring provided by the PCB to socket connections 44 and header socket 46. A secondary circuit may also be formed, which couples the secondary energy source 50 to the trigger element 12D of the high voltage switch 12, e.g., via separate wiring provided by the PCB to socket connections 44 and header socket 46, e.g., which may couple to the switch lands on the switch chip as illustrated in FIG. 7. In this regard, the secondary circuit may selectively connect to the secondary energy source 50 to the trigger element 12D, e.g., via an electronic switch disposed between the secondary energy source 50 and the trigger element 12D.

The primary and secondary circuits may be made to have extremely low inductance, e.g., less than 50 nanohenries. This low inductance helps facilitate the ability of the detonator according to various aspects of the present invention, to develop megawatts of power necessary to function the EFI-based initiator from a primary energy source such as a charge capacitor 48 that has a small size dimensioned to fit, for example, in a detonator housing of conventional size.

By way of illustration, the primary energy source 48 may be charged to an armed state of at least 800 V to 1,500 V by the low voltage to high voltage converter 54. Comparably, the secondary energy source 50 may be charged to a voltage of around 100 V or greater, e.g., between 100 V and 500 V. In this regard, the primary energy source 48 may include bleed down circuitry to charge the secondary energy source 50. Alternatively, the low voltage to high voltage converter 54 of the detonator 10A may include low voltage to high voltage circuitry to charge the primary energy source 48 and independent low voltage to high voltage circuitry to charge the secondary energy source 50. The timing of when the primary and secondary capacitors 48, 50 are charged and the overall operation of the detonator 10A is controlled by the controller 52. In this regard, detonation sequencing will be described in greater detail below.

The implementation of the initiator 14 as an EFI chip arrangement as described in greater detail herein improves accuracy and reliability of the initiator component compared to conventional EFI structures. Accordingly, the improved reliability and accuracy of this detonator may find many uses in commercial and defense applications. These potential applications range from rock blasting for military and commercial demolition to use a high precision/high capability research tool.

According to aspects of the present invention, low voltage power is provided to the detonator 10A via the detonator connector 56 and corresponding connecting cable 58. Alternatively, low voltage power may be provided using inductive methods, e.g., where it is undesirable or unpractical to wire the detonator 10A. The low voltage is applied to the on-board firing set, e.g., the primary and secondary capacitors 48, 50 and low voltage to high voltage converter 54 that is utilized to pump the power voltage up to the kilovolt levels required to fire the built-in initiator 14.

Comparatively, detonators, like EBWs, receive their high voltage pulse from an external firing set, and not from high voltage generating circuitry built into the detonator, as implemented in various aspects of the present invention. The conventional approach to using external firing sets limits the firing line distance because of the line inductance inherent in locating the firing set away from the detonator. For example, high line inductance limits the fast, high current pulses needed to "explode" the bridge wire that functions the conventional EBW. The external firing set further limits the number of detonators than can be fired on a single circuit. Additionally, existing commercial electronic detonators feature low voltage fuse heads, that do not contain the on board low inductance circuitry and low voltage to high voltage conversion electronics to charge the high voltage capacitors needed to fire EFIs or EBWs in their common configuration. Even though electronics replace the pyrotechnic delay train in these detonators, the low firing voltage of their fuse heads still make them vulnerable to detonation from inadvertent contact with common power sources, static electricity, or stray current sources.

However, the detonator 10A according to aspects of the present invention includes built in low voltage to high voltage conversion electronics, a high voltage switch 12 and an EFI-based initiator 14 while maintaining a packaging that appears as if it were a conventional detonator configuration, e.g., has the general size and shape of a typical detonator housing. As such, a blast operation can easily handle a multitude of detonators 10A in its "network".

Figure 9:
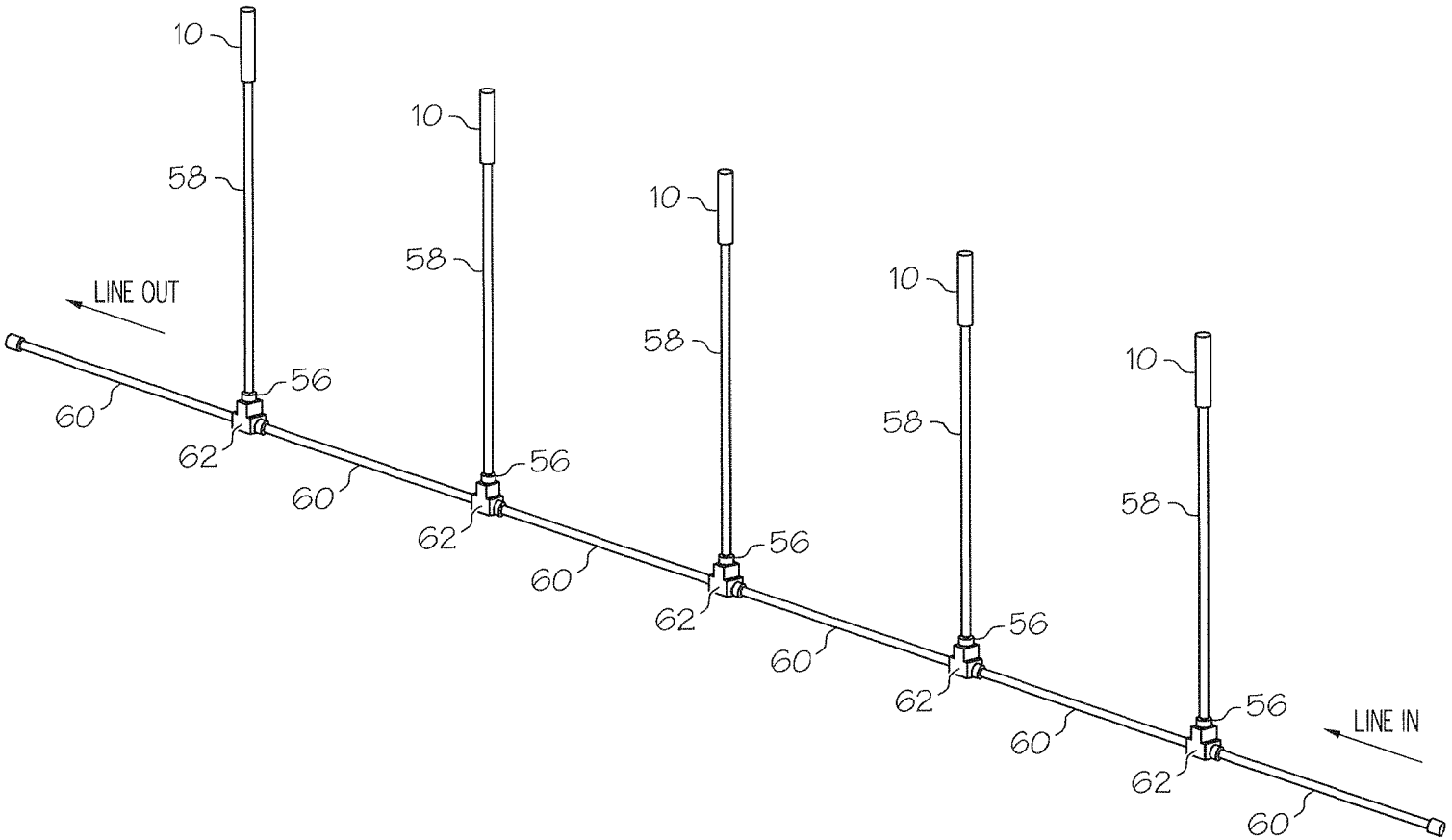
FIG. 9 is a diagram of a detonator network comprising a plurality of detonators according to various aspects of the present invention.

Referring to FIG. 9, according to various aspects of the present invention, a plurality of detonators 10, 10A may be connected together. In this regard, the detonators 10 may be "snapped" or otherwise connected into a single busline that forms a detonator network. For example, as illustrated in FIG. 9, the busline includes a plurality of busline sections 60 serially connected by corresponding connector blocks 62. Each detonator 10A connects to the busline by coupling the detonator connector 56 to a corresponding one of the connector blocks 62, thus coupling an associated detonator to the busline via its cable 58. In this regard, the firing line length is not practically limited when using the detonators 10, 10A as described in greater detail herein, because a high voltage is not being pumped through a corresponding network of interconnections 56, 58, 60, 62. That is, the busline is not carrying a high voltage necessary to function the switch 12 and/or initiator 14 of each detonator. As such, inherent losses in the network, e.g., due to cable resistance, inductance and/or capacitance, which can cause liabilities such as voltage drop or otherwise limit the fast, high current pulses necessary function the detonator(s) are mitigated.

The detonators 10 described more fully herein, offers significant technical advancement over existing commercial blasting, explosive research, and military detonators. For example, the detonator 10 according to aspects of the present invention comprises built in "safe" and "arm" systems via integration of a high voltage switch 12 with an initiator 14, and via separate circuitry for closing the high voltage switch 12 and for functioning the initiator 14, as described more fully herein. Moreover, the switch chip circuitry of the high voltage switch 12 offers a robust, redundant system, and may include its own low voltage to high voltage firing set and capacitor 50, while preserving the standard detonator form factor/shape of the detonator housing.

The control electronics 52 may be utilized to program each detonator 10, 10A for a given application. For instance, a desired firing time can be input into each detonator 10A. As such, multiple detonators may be easily linked in to the network. Such extremely high precision and high reliability are features that may find favor in the research and special forces community.

Alternate Detonator Arrangement

Figure 10:
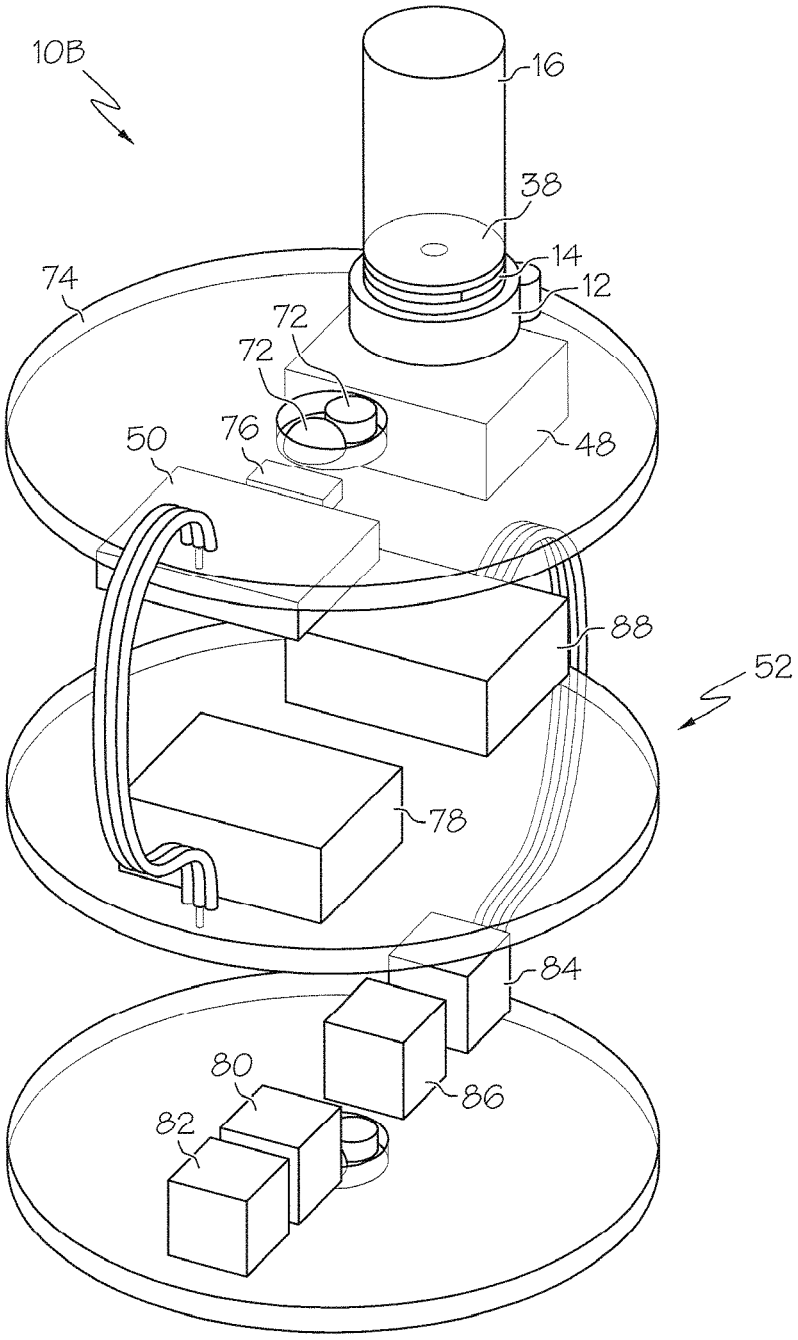
FIG. 10 is an illustration of a detonator according to still further aspects of the present invention.

Referring to FIG. 10, a detonator 10 is illustrated according to aspects of the present invention, and is thus further identified by the designation of reference numeral 10B. The detonator 10B is suitable for functioning as part of an operationally enhanced system for commercial blasting applications. The detonator 10B includes many of the same components described in greater detail herein with reference to the detonator 10, 10A. For instance, the detonator 10B includes a high voltage switch 12 that may be implemented as a high voltage switch chip, an initiator 14 that may be implemented as an EFI chip, an initiation pellet 16 that can be implemented as a single or multiple load detonator pellet using any of the techniques described more fully herein. Further, the detonator 10B includes a high voltage capacitor 48 that defines the primary energy source that powers the initiator 14. The detonator 10B also includes a secondary capacitor 50 that defines the secondary energy source that operates the high voltage switch 12. Still further, the detonator 10B includes control electronics 52 in a manner analogous to that described with reference to the detonator 10A.

The control electronics 52 may include one or more printed circuit boards (PCB) 74, bleed down resistors 76, low voltage to high voltage converter 78, e.g., a low voltage to high voltage converter, a programmable timing chip 80, a controller such as a microprocessor 82, self diagnostic components and related circuitry 84, burst communication circuitry 86 and radio frequency identification (RFID) circuitry 88. Particularly, any of the components described with respect to any one of the detonator configurations 10, 10A and 10B may be implemented in the remainder ones of the detonators described herein. For instance, one or more components of the control electronics 52 described with reference to FIG. 10 may also and/or alternatively be implemented with regard to the detonator 10A described with reference to FIG. 8. Similarly, one or more components of the control electronics 52 described with reference to FIG. 8 may also and/or alternatively be implemented with regard to the detonator 10B described with reference to FIG. 10.

In the illustrative implementation of the detonator 10B, the detonator housing is generally puck shaped. An inductive core may include one or more through tunnels 72 (two through tunnels 72 as illustrated) built into the center of the detonator puck, which may be utilized for inductive linking and communication. At least one of the through tunnels 72 includes an inductor proximate to the through tunnel 72, e.g., a toroidal inductor having a through hole generally coaxial with the corresponding through tunnel 72, which serves as an inductive pickup for communication with associated circuitry as will be described in greater detail herein. In this regard, inductive linking may be utilized by the detonator 10B as the primary communication and/or powering mechanism. The provision of the through tunnel(s) 72 further eliminates the need for a hardwired connection to the controller of the detonator 10B.

According to various aspects of the preset invention, the detonator 10B is connected to a suitable network by passing two separate wires through the two through tunnels 72 in the center of the puck, e.g., one wire passing through each through hole 72, and connecting the two ends together electrically after passing them through the puck. Alternatively, a single line could be threaded through the through hole 72 containing the inductor and held at a hole collar while the detonator 10B is lowered, e.g. by spooling out the other end of the line. The objective for this method is to end up with both ends of the wire at the hole collar while the detonator 10B is in the center of the loop at the hole bottom or otherwise positioned along the length of the wire at a desired position within the hole. Regardless of how the wire is passed through the tunnel(s) 72, the system should allow an electrical pulse to pass through the inductor and return back to the generation source outside of the inductor to enable two way communications between the detonator 10B and an external source.

The utilization of the through tunnel(s) also allows subsequent detonators 10B required for decking operations to be slid down the downline(s) into their desired positions defining an explosive column. Two way communications to the detonators 10B are achieved by a sending and receiving a specific series of specialized electrical pulses through the looping connection. The same inductive arrangement may also used to charge the high voltage capacitor 48 and/or the switch capacitor 50 to facilitate firing the initiator 14.

Thus, according to various aspects of the present invention, inductive means are utilized for two way communications to the detonator and for also powering up a high voltage firing capacitor, e.g., the primary capacitor 48 and/or the high voltage switch capacitor, e.g., the secondary capacitor 50.

Another attribute of the detonator 10B, according to various aspects of the present invention, is built in RFID technology 88, which is configured to provide the ability to automatically resolve each individual detonators position in a series, freeing the user from the time consuming and mistake prone task of manually identifying each detonator. For instance, the RFID feature provided by the RFID circuitry 88 may be utilized for the automatic identification of the positioning of multiple detonators 10B within a single hole. In this regard, the RFID circuitry 88 can cooperate with a controller to communicate via the inductor to an external source via the downline wiring, without requiring a hardwire connection to the detonator 10B.

In commercial applications, a regulatory requirement limiting the level of blasting induced vibration at a neighboring protected structure commonly limits the quantity of explosive that can be detonated within a timing delay "window". The mandated explosive quantity can often be less than that realized for a fully loaded blast hole. To achieve the maximum allowable explosive quantity in this situation, the technique of "decking" is often used. Decking separates multiple explosive charges within a single hole with inert separating material that is typically comprised of crushed stone or drill cuttings. Each independent charge must be individually fired within a separate timing window as not to surpass the mandated maximum pounds of explosives per delay period that dictates the produced vibration level. Independent charges within a single blasthole in decking applications typically range from two to four, although they are not limited to this range. In this regard, the proper identification of the detonator order from top to bottom is typically necessary for firing each detonator within the properly computed timing window. If a mistake is made in identifying the detonator position and it is fired out of sequence, all of the efforts to maintain vibration levels within the mandated parameters can be nullified resulting in damage liabilities for surrounding structures and the likelihood of fines and mandated cessation of blasting operations by regulatory agencies. However, the built-in ability of the detonator 10B to identify its position in the hole, e.g., via RFID, allows the blasting system to automatically configure the blasting sequence and timing, and thus eliminates the potential for error in manually logging the position of each detonator in each hole. Moreover, such automation promotes more efficient loading of detonators in each hole.

Compared to the detonator 10A described with reference to FIGS. 8, and 9, the detonator 10B implements a change in the configuration of a small diameter cylinder housing, into a larger diameter, but shorter "puck" type arrangement. The puck style configuration may include the same or different electrical features as the detonator 10A and vice versa. However, the puck housing conveniently facilitates housing the electronic components in such a way that allows communications and powering without "hardwired" connections in a manner where the wiring passes through the puck housing. The arrangement of the puck also allows extremely fast loading and customizable "cut to fit" lengths of common wiring for varying blasthole depths, or lengths between charges for demolition applications.

Figure 11A:
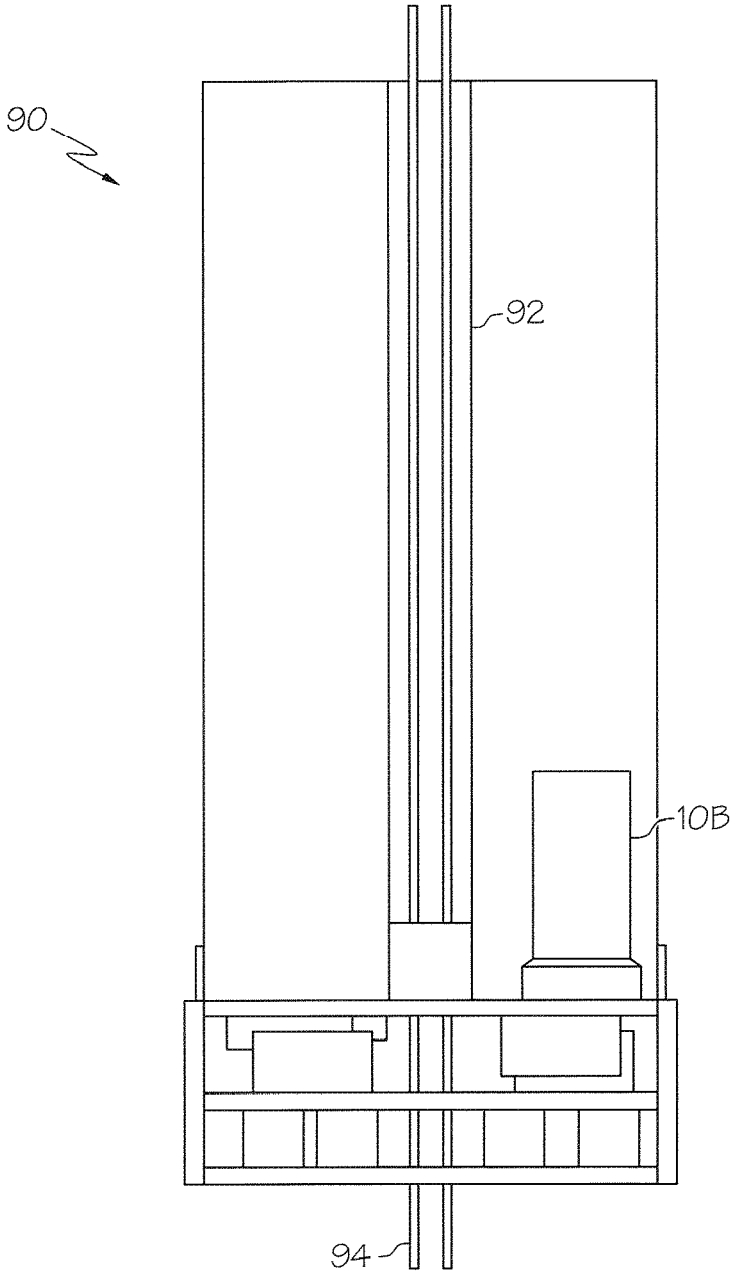
FIG. 11A is an illustration of a detonator installed in a booster according to aspects of the present invention.
Figure 11B:
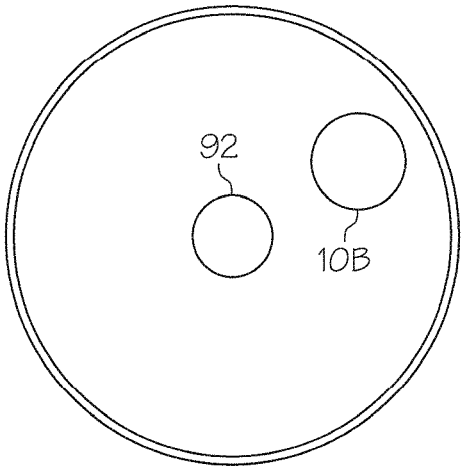
FIG. 11B is a top view of the detonator and booster of FIG. 11A, according to various aspects of the present invention.

Referring to FIGS. 11A, 11B, the detonator arrangement 10B is designed to interface with cast primers (boosters) 90 commonly used to initiate the blasting agents used for commercial blasting activities. Specialized boosters 90 mate with the puck style detonator 10B or adapters may accommodate existing, off-the-shelf boosters. The illustrated booster 90 includes a cord tunnel 92. At least one leg of a single downline 94 passes through the central cord tunnel 92, which is featured on substantially all conventional primers. The return line returns to the hole collar on the outside of the primer/detonator units. Additional detonator/primers needed in a specific hole would simply be slid down this line, requiring no additional downlines or connections.

The Hole Controller

Figure 12:
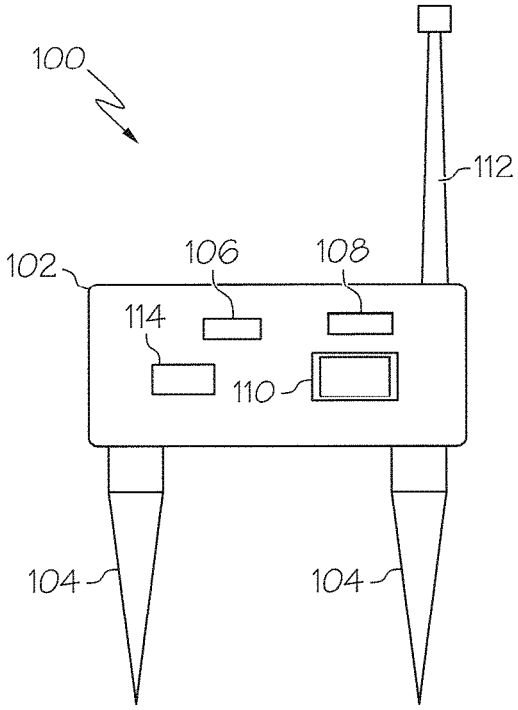
FIG. 12 is a schematic illustration of a hole controller according to various aspects of the present invention.

Referring to FIG. 12, according to various aspects of the present invention, a hardware component of a corresponding blasting system is the hole controller 100. The hole controller 100 includes a weatherproof case 102 and one or more spikes 104 for securing the hole controller 100 at a corresponding hole location. Because of the proximity of the hole controller 100 to the location of a designated blast, the hole controller 100 is considered an expendable component.

The single (two lead) downline 94 at each hole location connects to a corresponding hole controller 100, e.g., using quick connect terminals 106. As such, one hole controller 100 is communicably coupled to one or more detonators 10A, 10B, each detonator positioned at a different location along a corresponding downline 94.

The hole controller 100 also includes a power supply 108, e.g., a battery or other source for powering the associated downline detonators 10, 10A, 10B where the detonators 10A, 10B receive power inductively, network communication circuitry 110 and a corresponding network communication antenna 112. The communication circuitry 110 may include, for example, pulsing circuitry for communication to the detonator(s) 10A, 10B along the associated downline and/or radio electronics for wireless communication to a corresponding bench controller, described in greater detail herein. The hole controller 100 may also include position identification circuitry 114, such as global positioning system (GPS) positioning electronics. The GPS unit allows the automated positioning of the hole controller 100. In combination with the RFID circuitry 88 built into the various detonators 10A, 10B, the system can determine the position of the detonator array as well as the positioning of each detonator 10A, 10B within each blasthole. According to further aspects of the present invention, circuitry within each detonator 10, 10A, 10B may include position determining logic. For example, the microprocessor circuitry 82 may include GPS components. Under this configuration, the system may be able to automatically and precisely resolve the position of every detonator in a shot. The ability of automated detonator position determination provides unique efficiency gains for the hole loading process, such as the elimination of the hole to hole wiring required for conventional systems.

As noted above, the hole controller 100 may comprise specialized pulsing circuitry that communicates to each detonator, e.g., 10, 10A, 10B on its corresponding downline. The pulsing circuitry enables two way communications to each detonator 10B on an associated downline through the inductor/inductive pickup associated with each detonator. Where inductive communication is not utilized, the hole controller may communicate to each of the detonators on the corresponding downline using wired communications.

According to various aspects of the present invention, early in a blasting sequence, communication to each detonator 10A, 10B, e.g., via the inductive pickup arrangement or other wired or wireless connection, may be utilized to request that each detonator 10A, 10B along each downline perform diagnostics, e.g., via the self diagnostic components and circuitry 84. Each detonator 10A, 10B is further programmed with an assigned firing time, which may be loaded into a programmable timing circuitry 80. Again, communication may be implemented using wired or wireless communication, e.g., via the inductive pickup arrangement. Still further, the inductive pickup may be utilized in a subsequent portion of a blasting sequence, e.g., to power up the high voltage capacitor 48 and/or the switch capacitor 50 needed to fire the detonator(s), and execute the fire command, e.g., where it is undesirable or unpractical to include power built into the detonators 13.

Figure 13:
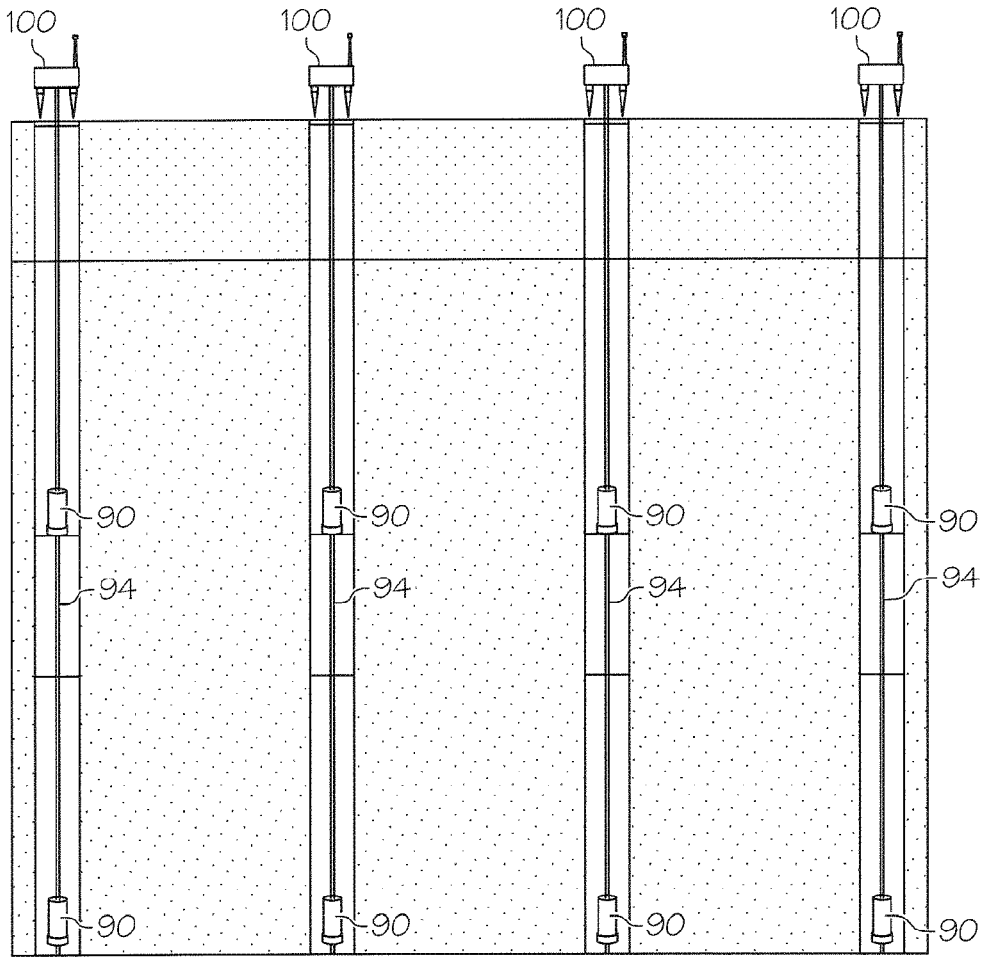
FIG. 13 is an illustration of a hole loading and blasting process according to various aspects of the present invention.

Referring to FIG. 13, as another illustrative example, position determining circuitry 114 of the hole controller 100, e.g., the GPS components may be utilized to fix the location of each hole, and the RFID identification components 86 may be utilized to identify the position sequence of each corresponding detonator down the hole when multiple in-hole detonators are used. In the illustrated figure, the detonators are installed in corresponding boosters 90, e.g., as described more fully herein. This technology enhancement is especially valuable for large shots covering a large area, like casting shots for coal mining operations or shots in mapped ore beds.

This automated positioning eliminates the errors that can arise because of manual assignment required by conventional processes. It also speeds the loading process, and requires no additional steps for the incorporation of additional, or out of pattern blastholes and associated detonator(s). Many existing systems require additional measures to accommodate added holes that were not part of the initial shot plan, complicating the system for the user and enhancing the potential for assignment errors.

The position determining capabilities of the hole controllers 100 may also offer unique tracking abilities when combined with mining plans. As an example, drill cuttings in precious metal ore beds are assayed to determine the position of the high yield areas within a shot area. Shots to fracture the ore bearing rock are typically designed to leave the highest bearing material in place, so that these high yield areas can be accurately extracted for subsequent processing. The automated positioning of the hole controllers 100 allow overlaying an electronic assaying map with the actual locations of each hole and corresponding detonator 10, 10A, 10B. This allows accurate, in the field adjustments of the shot timing plan to optimize breakage and shot movement related to the extraction of high value ores. This ability is not built into any current initiation system and would be valued by precious metal producers.

Shot applications that do not require as much precision in positioning, like trench shots or small area and shallow construction shots, could still make use of the efficiency offered by the combination of the hole controller 100 and corresponding detonators 10, 10A, 10B. In exemplary scenarios, a hole controller 100 is used to fix the position of an end hole in a series of single loaded detonator holes in a sequence. In this scenario a single detonator line connects the detonators 10, 10A, 10B in separate holes to a single hole controller 100. The hole controller 100 can then be utilized to identify the coordinates of the end hole for a sequence of each detonator 10, 10A, 10B in a series.

Multiple hole controllers 100 may then be used at the end holes in small shots to identify the edge of that shot, with all holes in that row feeding into the end hole controller 100 for a small shot. While this method would not identify the location of each hole, it would allow simple loading techniques. It would also identify the sequence of each detonator automatically and free an associated blaster controller from this task.

According to various aspects of the present invention, at least one wireless controller may be provided at each hole location, e.g., via the network communication circuitry 110 associated with each hole controller 100. The wireless arrangement of this system is designed to free associated blasters from the hole to hole wiring required by conventional systems. Moreover, providing a wireless controller offers a significant time advantage over conventional systems where wiring in the shot can consume significant labor costs. This wireless arrangement also leaves the shot surface free from the clutter of wiring networks. It also eliminates the potential for wiring mistakes as well as the potential to entanglement with personnel and blasting equipment used during the shot loading process. For instance, as noted schematically in FIG. 13, the illustrative arrangement enables no hole to hole wiring to clutter up the blast site.

According to various aspects of the present invention, a high voltage switch may be integrated into the wireless communications device of the hole controller 100. In this regard, the high voltage switch has a structure analogous to that of the high voltage switch 12 utilized in the detonator 10, 10A, 10B. This arrangement may be useful for blocking the possibility of inadvertent transmission of power to connected detonators. Such an arrangement provides a layer of redundancy where the wireless link, e.g., the network communication circuitry 112 of the hole controller 100 contains a detonator power source, e.g., a battery needed to function the detonator(s) 10, 10A, 10B in a corresponding downline.

For example, the high functioning voltage of the switch 12 would make a corresponding detonator 10, 10A, 10B immune to any probable inadvertent sources during the shot loading process. Once functioned upon "initialization" of the controllers when the bench has been cleared of personnel for the shot firing process, the one shot nature of this switch would allow ongoing communication and command firing of the detonators via wireless linking of the detonators through the controllers.

Hole Loading

Figure 14:
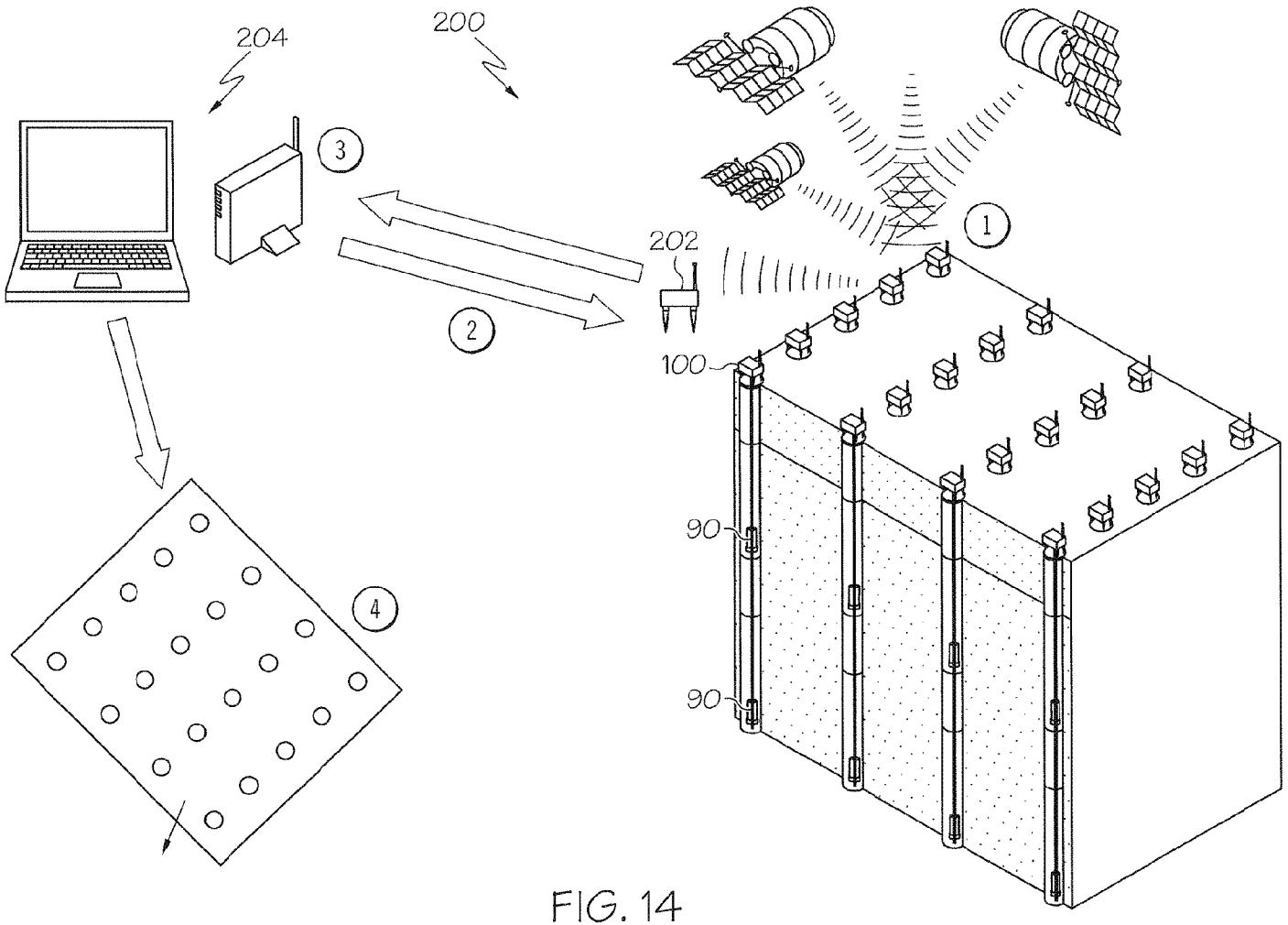
FIG. 14 is an illustration of a hole loading and blasting process according to further aspects of the present invention.

Referring to FIG. 14, a blasting system 200 is illustrated according to further aspects of the present invention. In the illustrative system, a plurality of downlines is created, each downline having one or more detonators 10, 10A, 10B. Moreover, a hole controller 100 may be positioned at one or more downlines as described in greater detail herein.

The system 200 also includes at least one shot controller 202. The hole controllers 100 each transmit detonator data and positioning information, e.g., GPS data wirelessly to the shot controller 202. The shot controller 202 in the illustrated exemplary implementation, is a piece of hardware that may be placed in the immediate vicinity of a shot and which can communicate wirelessly to the hole controller(s) 100 defining a hole controller network. While it may not be meant to be expendable, the shot controller 202 can be placed off the shot, but in an area that is deemed too close for blasting personnel to be placed during shot firing. The distance for the shot controller 202 to the shot may be designed to keep the wireless communication distances relatively short, e.g., less than 1,000 ft. (<about 300.5 meters), e.g., where there is a need to eliminate the wireless communication problems that can arise when transmitted over extended distances, such as in mountainous terrain.

A wireless connection may be implemented between the shot controller 202 and a blaster 204, e.g., a blasting computer system that may be positioned at a protected location where the blasting personnel would fire the shot. Alternatively, a dedicated hardwire line may be implemented between the shot controller 202 and the blaster 204. This arrangement is exactly opposite from conventional approaches that feature hardwiring to a bench controller, and wireless communication from the blasting computer to this bench controller.

The blaster 204 calculates a firing solution from user input and/or detonator data collected from the system, e.g., data collected from the one or more hole controllers 100 via the shot controller 202. Moreover, the automatic positioning hardware built into the system can, for example, show these positions and illustrate these positions on the computer screen of the blaster 204 via integrated shot software. The user can then accept or modify this calculated solution to suit the particular requirements. The blaster 204 then programs the firing times the in the various detonators, confirms a "Ready to Fire" status of all data and executes the fire command to function the various connected detonators. For example, according to various aspects of the present invention, after the shot firing solution has been accepted, the shot can be fired by the execution of a sequence of encrypted safety password features.

According to various aspects of the present invention, the shot controller 202 may provide wireless communication to the blaster 204. However, hardwiring may be utilized to eliminate the problems of wireless transmissions in certain environments, e.g., mountainous terrain, where wireless many mining operations are located. Additionally, wireless communication from the hole controllers 100 to the shot controller 202 in a local wireless network as described herein, facilitates shot loading time automated positioning.

In an exemplary implementation, a user positions a plurality of hole controllers 100 at a blast site. Particularly, one hole controller 100 is positioned at a corresponding blast hole location. The user connects at least one detonator to a downline and the detonator(s) are lowered into each blast hole location. The downline is also connected to the hole controller 100. The user also positions the shot controller 202 in the vicinity of the hole controllers 100 and communicably couples the shot controller 202 to the blaster 204, e.g., via wired or wireless communication. Upon initiation, the blaster 204 begins communicating with the hole controllers 100 via the shot controller 202 to identify the position and identification of the connected detonators. The detonators may also run self-diagnostics and perform other preliminary functions as described more fully herein. Based upon user input data and data gathered from the detonators, the blaster computes a firing solution, and transmits the firing times to each of the detonators via the shot controller 202 and corresponding hole controllers 100.

At an appropriate time, the blaster 204 initiates a charge command, wherein each detonator powers up the primary circuit. Because of the high voltage switch 12 in each detonator, charge is held off. However, each detonator will communicate back to the blaster 204 when the primary circuit has suitably charged. As such, the blaster 204 knows when all of the detonators are charged and ready. A similar acknowledgement may also be implemented for the secondary circuit that controls each high voltage switch 12. The blaster 204 may then synchronize the clocks of all of the detonators, e.g., to a GPS clock or other suitable reference. The blaster 204 may then initiate a go command to instruct the detonators to activate their high voltage switch 12 at the appropriate programmed times to set off a coordinated blast. Thus, the configuration described herein is not a charge to fire system. Moreover, the systems described herein reduce errors found in the tolerance of the time to charge and variance in discharge level of conventional devices.

General Overview

Various aspects of the present invention provide detonators and detonator systems that greatly enhance the accuracy of commercial available detonators, while simultaneously enhancing the efficiency and ease of use of electronic detonators. Moreover, the detonators and detonator systems according to various aspects of the present invention provide increased timing accuracy, and ease of use.

According to aspects of the present invention, and with reference to the various detonator and detonator system arrangements herein, the low voltage to high voltage DC to DC converter (firing set) may be powered by a source external to the detonator using inductive coupling. For example, a communications device may utilize near field RF to communicate a pulsed signal (specialized pulsed communication) of a predefined pattern. The pulsed signal is sensed by pickup electronics provided within the detonator, which provides the necessary powering mechanism to enable the operation of the detonator. Moreover, the pulsed signal may implement a predefined pattern that serves as a communications key that is required to enable the detonator for operation.

According to further aspects of the present invention, detonators are provided, which may include inductive powering and communications capability that limits the ability of the detonator to power up energy source(s) such as capacitors. As such, detonators are provided that are virtually immune to stray ground currents, electrostatic discharge (ESD), and radio frequency (RF) radiation. Moreover, conventional power sources are generally incapable of powering up the detonators as described in greater detail herein. Moreover, the pulsed communication provided between the hole controller 100 and the associated detonators 10 makes hacked communications to the detonator difficult. In this regard, the various aspects of the present invention may be utilized in a diverse range of applications, such as the Mining Industry, Construction Industry, Demolition Industry, Oil Exploration and Drilling Industry, Geophysical Applications, Defense Based Applications.

By way of illustration and not by way of limitation, a voltage such as approximately a 1 kV firing voltage and fast current profile required to function the initiator(s) 14, make actuation of the initiator(s) 14 almost impossible from common power sources. Additionally, the high voltage switch 12 adds an additional a layer of redundancy to the detonator. For instance, the high voltage switch 12, according to various aspects of the present invention, may be able to hold off high voltages from a primary firing capacitor. In this regard, the high voltage switch itself may require a high voltage, e.g., in excess of 100 V to function.

According to still further aspects of the present invention, a potted puck arrangement with a central through hole makes it undesirable and difficult and/or impossible to hook up the detonator to common power sources. Further, a detonator as described herein, only contains insensitive secondary explosives (such as HNS-IV, Composition A5, PBXN5, etc.). That is, no sensitive primaries are present.

According to still further aspects of the present invention, a blasting system is provided having a simple connection of single downline detonators that readily facilitates connecting multiple detonators, to a hole-controller, network system. In this regard, there is no need to log or record an individual ID of a corresponding detonator and there is no need to log or record the detonator position, relating to a significant time advantage in hole loading, because the system will automatically communicate with the positioned detonators to identify detonator positioning. Further, hole to hole wiring may be eliminated leaving the shot free of wires. Still further, position determining, such as GPS, in the hole controller 100 may be utilized to determine the position of each detonator 10, and RFID technology or other proximity detection technologies may be utilized to determine the position of each detonator in a corresponding downhole. As such, holes may be added to a shot dynamically without difficulty, even adding extra holes for a shot. In this regard, positioning determination may be utilized to identify the position of detonators, and the position of each reported detonator is handled by the corresponding blasting computer, which eliminates mistakes derived from manual misidentification in detonator positions.

According to still further aspects of the present invention, a wireless concept places a single "shot controller" on the bench to wirelessly communicate to each hole-controller. As such, sort transmission distances, e.g. between the hole controller 100 and the shot controller 204 are short which eliminates the problems of communications in mountainous terrain or other environments with a lot of interference. Moreover, the shot controller can either be hardwired or wireless to the remotely located blasting computer. Still further, the blasting computer may utilize software that takes advantage of automated detonator positioning for computing firing solutions. The blaster may employ constrains to be used by the algorithm computing the solution.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. An electronic detonator comprising:

a detonator housing that integrally packages a chip having a high voltage switch and an initiator, an initiating pellet, a primary energy source, a secondary energy source, and a controller, wherein:

the high voltage switch includes:

a first switch contact spaced from and electrically isolated from a second switch contact;

a trigger element that passes between and is spaced from the first switch contact and the second switch contact, wherein the trigger element is shaped as a repeating pattern of faceted sections that narrow in width and funnel out in width; and a dielectric material that overlies the high voltage switch, including the trigger element, wherein the trigger element shape and dielectric material contribute to establish a desired hold off voltage for the high voltage switch;

the initiator is connected in series to the first switch contact of the high voltage switch thus forming a series circuit between the initiator and the high voltage switch;

the initiating pellet is positioned relative to the initiator such that functioning of the initiator causes detonation of the initiating pellet; and the controller is operatively configured to function the initiator to detonate the initiating pellet by controlling:

the primary energy source to apply a desired primary charge potential to the series circuit including the initiator and the high voltage switch; and the secondary energy source to drive a current through the trigger element that is sufficient to close the high voltage switch by electrically connecting the first switch contact to the second switch contact.

2. The electronic detonator of claim 1, wherein:

the initiator includes an alumina substrate that forms a base layer;

the initiator is defined by a bridgefoil that is provided on the alumina substrate, the bridgefoil defining a narrowed-in channel between a first initiator pad and a second initiator pad;

the first initiator pad is electrically coupled to the primary energy source to function the initiator;

a flyer layer is positioned over at least the narrowed-in channel of the bridgefoil;

a barrel is positioned over the flyer layer; and the initiating pellet is positioned over the barrel.

3. The electronic detonator of claim 2, wherein:

the high voltage switch is integrated onto the same alumina substrate as the initiator such that the second initiator pad is electrically coupled to the first switch contact and the second switch contact completes the circuit with the primary energy source.

4. The electronic detonator of claim 1, wherein:

the faceted configuration of the trigger element is implemented as a repeating row of butterfly banded regions where the width of the trigger element repeatedly narrows into a channel shape, then funnels out to a wider shape;

the first switch contact has a first edge shaped in a configuration that is complementary to a proximate edge of the trigger element;

the second switch contact has a second edge shaped in a configuration that is complementary to a proximate edge of the trigger element.

5. The electronic detonator of claim 1, wherein:

the faceted configuration of the trigger element is implemented as at least one of serpentine, saw toothed, ramped and jagged;

the first switch contact has a first edge shaped in a configuration that is complementary to a proximate edge of the trigger element;

the second switch contact has a second edge shaped in a configuration that is complementary to a proximate edge of the trigger element.

6. The electronic detonator of claim 1, wherein:

the initiator comprises an exploding foil initiator that projects a flyer through a barrel into the initiating pellet in response to being functioned; and the initiating pellet comprises a combination pellet configured such that the insensitive secondary explosive material is positioned in an area where the flyer will impact the initiating pellet, the initiating pellet further comprising a high brisance insensitive secondary explosive material as the remainder of explosive material of the initiating pellet.

7. The electronic detonator of claim 1, wherein:

the secondary energy source is defined by bleed-down circuitry that bleeds down the voltage of the primary energy source.

8. An electronic detonator comprising:

a generally puck shaped detonator housing having at least one through tunnel that extends through the puck, the housing further integrally packaging a chip having a high voltage switch and an initiator, an initiating pellet, a primary energy source, a secondary energy source, a controller, and an inductor proximate to a select one of the through tunnels, wherein:

the high voltage switch includes:

a first switch contact spaced from and electrically isolated from a second switch contact;

a trigger element that passes between and is spaced from the first switch contact and the second switch contact, wherein the trigger element is shaped as a repeating pattern of faceted sections that narrow in width and funnel out in width; and a dielectric material that overlies the high voltage switch, including the trigger element, wherein the trigger element shape and dielectric material contribute to establish a desired hold off voltage for the high voltage switch;

the initiator is connected in series to the first switch contact of the high voltage switch thus forming a series circuit between the initiator and the high voltage switch;

the initiating pellet is positioned relative to the initiator such that functioning of the initiator causes detonation of the initiating pellet; and the inductor is coupled to the controller of the detonator as an inductive pickup for wireless communication with an external source, the inductive pickup receiving a command to instruct the controller to function the initiator to detonate the initiating pellet by controlling:

the primary energy source to apply a desired primary charge potential to the series circuit including the initiator and the high voltage; switch, and the secondary energy source to drive a current through the trigger element that is sufficient to close the high voltage switch by electrically connecting the first switch contact to the second switch contact.

9. The detonator according to claim 8, wherein:

the inductor comprises a toroidal inductor that is generally coaxial with the corresponding through tunnel.

10. The detonator according to claim 8, further comprising:

communications circuitry that allows the controller to communicate information to an external source and to receive timing information to program a detonation time.

11. The detonator according to claim 8, further comprising:

a radio frequency identification device that identifies the detonator to an external source.

12. The detonator according to claim 8, wherein:

the initiator comprises an exploding foil initiator that projects a flyer through a barrel into the initiating pellet in response to being functioned; and the initiating pellet comprises a combination pellet that includes a first insensitive secondary in an area where the flyer will impact the initiating pellet, and a high brisance insensitive secondary explosive material as the remainder of explosive material of the initiating pellet.

13. The electronic detonator of claim 8, wherein:

the faceted configuration of the trigger element is implemented as a repeating row of butterfly banded regions where the width of the trigger element repeatedly narrows into a channel shape, then funnels out to a wider shape;

the first switch contact has a first edge shaped in a configuration that is complementary to a proximate edge of the trigger element;

the second switch contact has a second edge shaped in a configuration that is complementary to a proximate edge of the trigger element.

14. The electronic detonator of claim 8, wherein:

the faceted configuration of the trigger element is implemented as at least one of serpentine, saw toothed, ramped and jagged;

the first switch contact has a first edge shaped in a configuration that is complementary to a proximate edge of the trigger element;

the second switch contact has a second edge shaped in a configuration that is complementary to a proximate edge of the trigger element.

15. A system for performing blasting operations comprising:

a plurality of hole controllers, each hole controller for positioning at a corresponding blast hole in a corresponding blast site;

at least one detonator for each blast hole that is in communication with the corresponding hole controller associated with that blast hole, each detonator having a detonator housing that integrally packages a chip having a high voltage switch and an initiator, an initiating pellet, a primary energy source, a secondary energy source, communications circuitry for communicating with the associated hole controller and a detonator controller, wherein:

the high voltage switch includes:

a first switch contact spaced from and electrically isolated from a second switch contact;

a trigger element that passes between and is spaced from the first switch contact and the second switch contact, wherein the trigger element is shaped as a repeating pattern of faceted sections that narrow in width and funnel out in width; and a dielectric material that overlies the high voltage switch, including the trigger element, wherein the trigger element shape and dielectric material contribute to establish a desired hold off voltage for the high voltage switch;

the initiator is connected in series to the first switch contact of the high voltage switch thus forming a series circuit between the initiator and the high voltage switch;

the initiating pellet is positioned relative to the initiator such that functioning of the initiator causes detonation of the initiating pellet; and the controller is operatively configured to function the initiator to detonate the initiating pellet by controlling:

the primary energy source to apply a desired primary charge potential to the series circuit including the initiator and the high voltage switch, and the secondary energy source to drive a current through the trigger element that is sufficient to close the high voltage switch by electrically connecting the first switch contact to the second switch contact;

a shot controller for wireless communication with each of the hole controllers; and a blasting computer that communicates with the shot controller for coordinating a blast event, the blasting computer operatively configured to:

obtain data from each of the detonators via their corresponding hole controller and the shot controller;

calculate a firing solution;

automatically program each detonator with a corresponding detonation time based upon the calculated firing solution;

initiate an arm sequence, wherein the controller of each detonator charges the primary energy source to a desired primary charge potential, wherein the high voltage switch holds off the primary charge potential from functioning the initiator while the detonator is armed;

receive a confirmation that each detonator is armed and ready to fire; and initiate a blast command after acknowledging that detonators are armed to function the initiator at the corresponding programmed detonation time.

16. The system of claim 15, wherein:

each hole controller comprises pulsing circuitry for two-way communications to each detonator on an associated downline through an inductive pickup associated with each detonator.

17. The system of claim 15, wherein:

global positioning system components are utilized to fix the location of each blasting hole in the corresponding blast site; and a radio frequency identification component of each detonator is utilized to identify the position sequence of each corresponding detonator down the blasting hole.

18. The electronic detonator of claim 15, wherein:

the housing of each detonator comprises a generally puck shaped detonator housing having two through tunnels that extend through the puck;

each detonator further comprises an inductor coupled to the detonator controller; and each detonator is mounted to a booster having an interface that mates with the puck-shaped housing and a cord tunnel that extends through a housing of the booster so as to enable inductive communication with the inductor.

19. The electronic detonator of claim 18, wherein:

each detonator is connected to an associated downline of the blasting network at a down hole by passing a wire through each of the two through tunnels in the puck, so as to end up with both ends of the wire at a hole collar while the detonator is in the center of the loop at the hole bottom or otherwise positioned along the length of the wire at a desired position within the hole such that an electrical pulse can pass through the inductor and return back to the generation source outside of the inductor to enable two way communications between the detonator and the corresponding hole controller.

* * * * *